US009636882B2

(12) United States Patent
Holley, Jr.

(10) Patent No.: US 9,636,882 B2
(45) Date of Patent: May 2, 2017

(54) CARTON WITH REINFORCED HANDLE

(71) Applicant: GRAPHIC PACKAGING INTERNATIONAL, INC., Atlanta, GA (US)

(72) Inventor: John Murdick Holley, Jr., Lawrenceville, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/828,791

(22) Filed: Aug. 18, 2015

(65) Prior Publication Data

US 2016/0052676 A1 Feb. 25, 2016

Related U.S. Application Data

(60) Provisional application No. 62/070,269, filed on Aug. 19, 2014.

(51) Int. Cl.
*B65D 25/30* (2006.01)
*B31B 3/26* (2006.01)
*B65D 71/36* (2006.01)

(52) U.S. Cl.
CPC ..... *B31B 3/26* (2013.01); *B65D 71/36* (2013.01); *B65D 2571/0045* (2013.01);
(Continued)

(58) Field of Classification Search
CPC B65D 25/30; B65D 2571/0045; B65D 71/36; B65D 5/4608; B65D 5/0227; B65D 5/443; B65D 5/0281; B31B 3/26
USPC ..... 229/117.16, 244, 117.13, 117.17, 240, 229/103.2, 200; 206/427; 220/676; 493/162, 88, 405, 89; 53/456, 458
See application file for complete search history.

(56) References Cited

U.S. PATENT DOCUMENTS 1,253,193 A 1/1918 Hill
2,122,654 A 7/1938 Nickerson
(Continued)

FOREIGN PATENT DOCUMENTS

CA 877792 8/1971
CA 2 160 145 9/1995
(Continued)

OTHER PUBLICATIONS

International Search Report and Written Opinion for PCT/US2015/045622 dated Nov. 6, 2015.

*Primary Examiner* — Christopher Demeree
(74) *Attorney, Agent, or Firm* — Womble Carlyle Sandridge & Rice, LLP

(57) ABSTRACT

A carton for holding a plurality of articles. The carton can comprise a plurality of panels comprising at least a top panel and a side panel. A plurality of end flaps can be respectively foldably connected to respective panels of the plurality of panels, can be at least partially overlapped to at least partially form a closed end of the carton, and can comprise at least a side end flap foldably connected to the side panel along a first fold line. A handle can be formed in the closed end of the carton for grasping and carrying the carton. The handle can extend in at least the side end flap. A reinforcing flap can be foldably connected to the side end flap along a second fold line, and the reinforcing flap can at least partially overlap the side end flap for reinforcing the handle.

43 Claims, 19 Drawing Sheets

(52) U.S. Cl.
CPC ..... *B65D 2571/0066* (2013.01); *B65D 2571/00141* (2013.01); *B65D 2571/00265* (2013.01); *B65D 2571/00524* (2013.01); *B65D 2571/00574* (2013.01); *B65D 2571/00728* (2013.01)

(56) References Cited

U.S. PATENT DOCUMENTS 2,196,502 A 4/1940 Kells
2,308,050 A 1/1943 Burr
2,383,183 A 8/1945 Fischer
2,386,905 A 10/1945 Meitzen
2,568,204 A 9/1951 Reeser
2,594,376 A 4/1952 Arneson
2,645,405 A 7/1953 Dorfman
2,648,484 A 8/1953 Belsinger
2,665,050 A 1/1954 Baumann
2,702,144 A 2/1955 Forrer
2,702,155 A 2/1955 Baumann
2,797,856 A 7/1957 Jaeschke
2,810,506 A 10/1957 Kessler
2,811,298 A 10/1957 Jones
2,868,433 A 1/1959 Anderson, Jr.
2,900,123 A 8/1959 Drnec et al.
2,955,739 A 10/1960 Collura
3,055,569 A 9/1962 Layne, Sr.
3,094,268 A 6/1963 Swanson et al.
3,112,856 A 12/1963 MacIntosh et al.
3,127,720 A 4/1964 Gentry et al.
3,173,596 A 3/1965 Aust et al.
3,204,815 A 9/1965 Weiss
3,309,005 A 3/1967 Pilger
3,334,767 A 8/1967 Cornelius et al.
3,355,012 A 11/1967 Weiss
3,381,881 A 5/1968 Granz et al.
3,756,499 A 9/1973 Giebel et al.
3,828,926 A 8/1974 Rossi
3,881,648 A 5/1975 Hall
3,886,901 A 6/1975 Zeitter
3,904,036 A 9/1975 Forrer
3,927,822 A 12/1975 Giebel
3,933,303 A 1/1976 Kirby, Jr.
3,994,432 A 11/1976 Kirby, Jr.
4,005,815 A 2/1977 Nerenberg et al.
4,029,204 A 6/1977 Manizza
4,029,207 A 6/1977 Gordon
4,036,423 A 7/1977 Gordon
4,096,985 A 6/1978 Wood
4,101,048 A 7/1978 Rieben et al.
4,101,052 A 7/1978 Dove
4,105,152 A 8/1978 Elward
4,111,306 A 9/1978 Roccaforte
4,165,031 A 8/1979 Osborne
4,216,861 A 8/1980 Oliff
4,318,474 A 3/1982 Hasegawa
4,328,923 A 5/1982 Graser
4,329,923 A 5/1982 Iida
4,331,289 A 5/1982 Killy
4,364,509 A 12/1982 Holley et al.
4,375,258 A 3/1983 Crayne et al.
4,378,905 A 4/1983 Roccaforte
4,382,505 A 5/1983 Sutherland et al.
4,424,901 A 1/1984 Lanier
4,440,340 A 4/1984 Bakx
4,478,334 A 10/1984 Graser
4,498,619 A 2/1985 Roccaforte
4,508,258 A 4/1985 Graser
4,538,759 A 9/1985 Dutcher
4,545,485 A 10/1985 Oliff
4,546,914 A 10/1985 Roccaforte
4,588,084 A 5/1986 Holley, Jr.
4,621,766 A 11/1986 McClure
4,653,686 A 3/1987 Wood et al.
4,679,726 A 7/1987 Oliff
4,706,876 A 11/1987 Wilson
4,747,487 A 5/1988 Wood
4,784,266 A 11/1988 Chaussadas
4,784,316 A 11/1988 Crouch
4,802,583 A 2/1989 Calvert et al.
4,830,267 A 5/1989 Wilson
4,875,586 A 10/1989 Chaussadas
4,966,324 A 10/1990 Steel
4,981,254 A 1/1991 Depper
5,020,337 A 6/1991 Krieg
5,060,792 A 10/1991 Oliff
5,072,876 A 12/1991 Wilson
5,094,359 A 3/1992 DeMars et al.
5,106,014 A 4/1992 Miller
5,119,985 A 6/1992 Dawson et al.
5,197,598 A 3/1993 Stout et al.
5,221,041 A 6/1993 Stout et al.
5,222,658 A 6/1993 DeMaio et al.
5,234,102 A 8/1993 Schuster et al.
5,246,112 A 9/1993 Stout et al.
5,284,294 A 2/1994 Floyd
5,292,058 A 3/1994 Zoss et al.
5,297,725 A 3/1994 Sutherland
5,303,863 A 4/1994 Arasim
5,307,932 A 5/1994 Stout et al.
5,307,986 A 5/1994 Schuster
5,320,277 A 6/1994 Stout et al.
5,333,734 A 8/1994 Stout et al.
5,350,109 A 9/1994 Brown et al.
5,379,944 A 1/1995 Stout et al.
5,381,891 A 1/1995 Harris
5,385,234 A 1/1995 Stout et al.
5,395,044 A 3/1995 Stout
5,427,241 A 6/1995 Sutherland
5,458,234 A 10/1995 Harris
5,472,090 A 12/1995 Sutherland
5,472,136 A 12/1995 Roccaforte
5,485,915 A 1/1996 Harris
5,495,727 A 3/1996 Strong et al.
5,524,756 A 6/1996 Sutherland
5,551,556 A 9/1996 Sutherland
5,582,343 A 12/1996 Dalvey
5,588,585 A 12/1996 McClure
5,639,017 A 6/1997 Fogle
5,647,483 A 7/1997 Harris
5,669,500 A 9/1997 Sutherland
5,699,957 A 12/1997 Blin et al.
5,704,470 A 1/1998 Sutherland
5,738,273 A 4/1998 Auclair
5,739,273 A 4/1998 Engelman et al.
5,794,778 A 8/1998 Harris
5,826,782 A 10/1998 Stout
5,873,515 A 2/1999 Dunn et al.
5,878,946 A 3/1999 Frerot et al.
5,915,546 A 6/1999 Harrelson
5,992,733 A 11/1999 Gomes
6,019,276 A 2/2000 Auclair
6,021,897 A 2/2000 Sutherland
6,065,590 A 5/2000 Spivey
6,085,969 A 7/2000 Burgoyne
6,105,853 A 8/2000 Lamare
6,105,854 A 8/2000 Spivey et al.
6,112,977 A 9/2000 Sutherland et al.
6,131,803 A 10/2000 Oliff et al.
6,164,526 A 12/2000 Dalvey
6,170,741 B1 1/2001 Skolik et al.
6,227,367 B1 5/2001 Harrelson et al.
6,250,542 B1 * 6/2001 Negelen ..... B65D 71/36 206/427
6,260,755 B1 7/2001 Bates et al.
6,273,330 B1 8/2001 Oliff et al.
6,302,320 B1 10/2001 Stout
D452,154 S 12/2001 Rhodes et al.
6,425,520 B1 7/2002 Peterson
6,523,739 B2 2/2003 Heeley et al.
6,595,411 B2 7/2003 McClure
6,631,803 B2 10/2003 Rhodes et al.
6,758,337 B2 7/2004 Chargueraud et al.
6,766,940 B2 7/2004 Negelen
6,834,793 B2 12/2004 Sutherland

(56) References Cited

U.S. PATENT DOCUMENTS

| | | | |
|---|---|---|---|
| 6,848,573 | B2 | 2/2005 | Gould et al. |
| 6,869,009 | B2 | 3/2005 | Sutherland et al. |
| 6,899,221 | B2 | 5/2005 | Skolik et al. |
| 6,905,066 | B2 | 6/2005 | Holley et al. |
| 6,926,193 | B2 | 8/2005 | Smalley |
| 6,945,450 | B2 | 9/2005 | Rusnock |
| 6,968,992 | B2 | 11/2005 | Schuster |
| 7,234,596 | B2 | 6/2007 | Lebras |
| 7,296,731 | B2 | 11/2007 | Auclair et al. |
| 7,380,701 | B2 | 6/2008 | Fogle et al. |
| 7,416,109 | B2 | 8/2008 | Sutherland |
| 7,427,010 | B2 | 9/2008 | Sutherland |
| 7,472,791 | B2 | 1/2009 | Spivey, Sr. |
| 7,601,111 | B2 | 10/2009 | Sutherland et al. |
| 7,614,497 | B2 | 11/2009 | Spivey, Sr. |
| 7,699,215 | B2 | 4/2010 | Spivey, Sr. |
| 7,703,666 | B2 | 4/2010 | Hand et al. |
| 7,743,944 | B2 | 6/2010 | Ho Fung et al. |
| 7,743,970 | B2 | 6/2010 | Bates et al. |
| 7,748,603 | B2 | 7/2010 | Fogle et al. |
| 7,757,933 | B2 | 7/2010 | Dunn |
| 7,775,418 | B2 | 8/2010 | Walling |
| 7,780,003 | B2 | 8/2010 | Harrelson |
| 7,780,067 | B2 | 8/2010 | Holley, Jr. |
| 7,806,314 | B2 | 10/2010 | Sutherland |
| 7,815,097 | B2 | 10/2010 | Fogle et al. |
| 7,832,622 | B2 | 11/2010 | Spivey, Sr. |
| 7,854,371 | B2 | 12/2010 | Mittelstaedt |
| 7,900,816 | B2 | 3/2011 | Kastanek et al. |
| 7,959,062 | B2 | 6/2011 | Auclair |
| 7,984,843 | B2 | 7/2011 | Cooper et al. |
| 7,998,047 | B2 | 8/2011 | Spivey, Sr. et al. |
| 8,070,052 | B2 | 12/2011 | Spivey, Sr. et al. |
| 8,186,569 | B2 | 5/2012 | Kelly |
| 8,191,761 | B2 | 6/2012 | Brand |
| 8,216,118 | B2 | 7/2012 | Dunn |
| 8,231,513 | B2 | 7/2012 | Smalley |
| 8,302,811 | B2 | 11/2012 | Spivey |
| 8,356,743 | B2 | 1/2013 | Spivey, Sr. |
| 8,453,918 | B2 | 6/2013 | Hsiao et al. |
| 8,602,292 | B2 | 12/2013 | Brand |
| 8,783,550 | B2 | 7/2014 | Schuster |
| 8,967,380 | B2 | 3/2015 | Moncrief et al. |
| 9,073,680 | B2 | 7/2015 | Kastanek |
| 9,187,206 | B2 | 11/2015 | Holley, Jr. |
| 2003/0213263 | A1 | 11/2003 | Woog |
| 2004/0074954 | A1 | 4/2004 | Fogle et al. |
| 2005/0056658 | A1 | 3/2005 | Spivey |
| 2005/0087592 | A1 | 4/2005 | Schuster |
| 2005/0167478 | A1 | 8/2005 | Holley, Jr. |
| 2005/0189405 | A1 | 9/2005 | Gomes et al. |
| 2005/0263574 | A1 | 12/2005 | Schuster |
| 2006/0071058 | A1 | 4/2006 | Spivey, Sr. |
| 2006/0081691 | A1 | 4/2006 | Smalley |
| 2006/0169755 | A1 | 8/2006 | Spivey, Sr. |
| 2006/0273143 | A1 | 12/2006 | Finch |
| 2006/0278689 | A1 | 12/2006 | Boshinski et al. |
| 2007/0039846 | A1 | 2/2007 | Spivey, Sr. |
| 2007/0051781 | A1 | 3/2007 | Holley, Jr. |
| 2007/0063003 | A1 | 3/2007 | Spivey et al. |
| 2007/0108261 | A1 | 5/2007 | Schuster |
| 2007/0131748 | A1 | 6/2007 | Brand |
| 2007/0164091 | A1 | 7/2007 | Fogle et al. |
| 2007/0181658 | A1 | 8/2007 | Sutherland |
| 2007/0205255 | A1 | 9/2007 | Dunn |
| 2007/0284424 | A1 | 12/2007 | Holley |
| 2007/0295789 | A1 | 12/2007 | Ho Fung |
| 2008/0083820 | A1 | 4/2008 | Walling et al. |
| 2008/0110967 | A1 | 5/2008 | Walling |
| 2008/0119344 | A1 | 5/2008 | Sutherland et al. |
| 2008/0128479 | A1 | 6/2008 | Bates et al. |
| 2008/0203143 | A1* | 8/2008 | Holley ..... B65D 5/0227 229/117.16 |
| 2008/0257943 | A1 | 10/2008 | Blin |
| 2009/0212095 | A1 | 8/2009 | Auclair |
| 2009/0236408 | A1 | 9/2009 | Spivey, Sr. |
| 2009/0255983 | A1 | 10/2009 | De Paula et al. |
| 2010/0025457 | A1 | 2/2010 | Cooper et al. |
| 2010/0044420 | A1 | 2/2010 | Brand |
| 2010/0213249 | A1 | 8/2010 | Requena |
| 2011/0240725 | A1 | 10/2011 | Spivey, Sr. et al. |
| 2011/0284624 | A1 | 11/2011 | DeBusk et al. |
| 2012/0012600 | A1 | 1/2012 | Gonzalez |
| 2012/0067755 | A1 | 3/2012 | Spivey, Sr. |
| 2012/0091021 | A1 | 4/2012 | Smalley |
| 2013/0092725 | A1 | 4/2013 | Kastanek |
| 2013/0214037 | A1 | 8/2013 | Holley, Jr. |

FOREIGN PATENT DOCUMENTS

| | | |
|---|---|---|
| DE | 85 14 718.4 | 6/1985 |
| DE | 296 07 374 | 4/1996 |
| DE | 201 12 228 | 11/2002 |
| DE | 2004 018 649 | 4/2005 |
| EP | 0412226 | 2/1991 |
| EP | 0 434 401 | 6/1991 |
| EP | 0 473 266 | 3/1992 |
| EP | 0870688 | 10/1998 |
| EP | 1 612 157 | 1/2006 |
| FR | 1 494 239 | 9/1967 |
| FR | 2 579 175 | 9/1986 |
| JP | 3-84717 | 8/1991 |
| JP | 03039805 | 3/2000 |
| KR | 20-0356729 | 7/2004 |
| WO | WO 96/27538 | 9/1996 |
| WO | WO 99/28198 | 6/1999 |
| WO | WO 99/28207 | 6/1999 |
| WO | WO 00/78618 | 12/2000 |
| WO | WO 01/66434 | 9/2001 |
| WO | WO 03/037742 | 5/2003 |
| WO | WO 2005/080218 | 9/2005 |
| WO | WO 2005/123532 | 12/2005 |
| WO | WO 2006/135918 | 12/2006 |
| WO | WO 2007/089282 | 8/2007 |
| WO | WO 2008/027954 | 3/2008 |

* cited by examiner

CARTON WITH REINFORCED HANDLE

CROSS-REFERENCE TO RELATED APPLICATIONS

This application claims the benefit of U.S. Provisional Patent Application No. 62/070,269, filed on Aug. 19, 2014.

INCORPORATION BY REFERENCE

The disclosure of U.S. Provisional Patent Application No. 62/070,269, which was filed on Aug. 19, 2014, is hereby incorporated by reference for all purposes as if presented herein in its entirety.

BACKGROUND OF THE DISCLOSURE

The present disclosure generally relates to cartons for holding beverage containers or other types of articles. More specifically, the present disclosure relates to cartons having a reinforced handle.

SUMMARY OF THE DISCLOSURE

In general, one aspect of the disclosure is directed to a carton for holding a plurality of articles. The carton comprises a plurality of panels that extends at least partially around an interior of the carton. The plurality of panels can comprise at least a top panel and a side panel. A plurality of end flaps can be respectively foldably connected to respective panels of the plurality of panels. The plurality of end flaps can be at least partially overlapped with respect to one another to thereby at least partially form a closed end of the carton, and the plurality of end flaps can comprise at least a side end flap foldably connected to the side panel along a first fold line. A handle can be formed in the closed end of the carton for grasping and carrying the carton. The handle can extend in at least the side end flap. A reinforcing flap can be foldably connected to the side end flap along a second fold line, and the reinforcing flap can at least partially overlap the side end flap for reinforcing the handle.

In another aspect, the disclosure is generally directed to a blank for forming a carton for holding a plurality of containers. The blank can comprise a plurality of panels comprising at least a top panel and a side panel. A plurality of end flaps can be respectively foldably connected to respective panels of the plurality of panels. The plurality of end flaps can be for being at least partially overlapped with respect to one another to thereby at least partially form a closed end of the carton formed from the blank, and the plurality of end flaps can comprise at least a side end flap foldably connected to the side panel along a first fold line. Handle features can be for forming a handle in the closed end of the carton formed from the blank. The handle features can extend in at least the side end flap. A reinforcing flap can be foldably connected to the side end flap along a second fold line. The reinforcing flap can be for at least partially overlapping the side end flap for reinforcing the handle when the carton is formed from the blank.

In another aspect, the disclosure is generally directed to a method of forming a carton for holding a plurality of articles. The method can comprise obtaining a blank comprising a plurality of panels comprising at least a top panel and a side panel and a plurality of end flaps respectively foldably connected to respective panels of the plurality of panels. The plurality of end flaps can comprise at least a side end flap foldably connected to the side panel along a first fold line. The blank further can comprise handle features extending in at least the side end flap and a reinforcing flap foldably connected to the side end flap along a second fold line. The method also can comprise positioning the reinforcing flap to at least partially overlap the side end flap, at least partially forming an interior of the carton by positioning the plurality of panels to form a generally open-ended sleeve, and at least partially overlapping the end flaps of the plurality of end flaps with respect to one another to at least partially form a closed end of the carton. The at least partially overlapping the end flaps can at least partially form a handle from the handle features in the closed end of the carton, and the reinforcing flap can at least partially reinforce the handle.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "outer," "lower," "bottom," "upper," and "top" indicate orientations determined in relation to fully erected and upright cartons.

Figure 1:
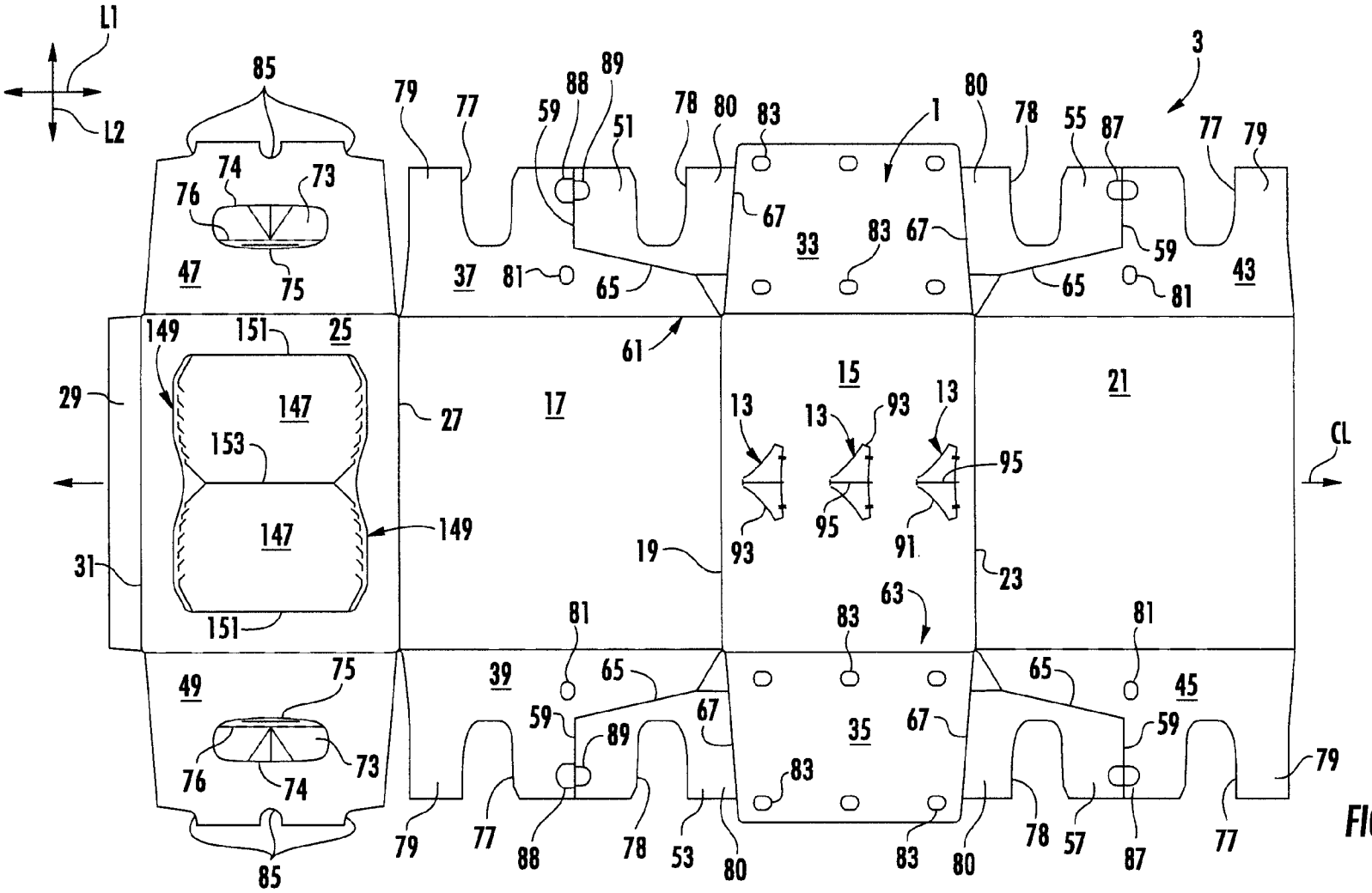
FIG. 1 is an exterior plan view of a blank used to form a carton according to a first exemplary embodiment of the disclosure.
Figure 6:
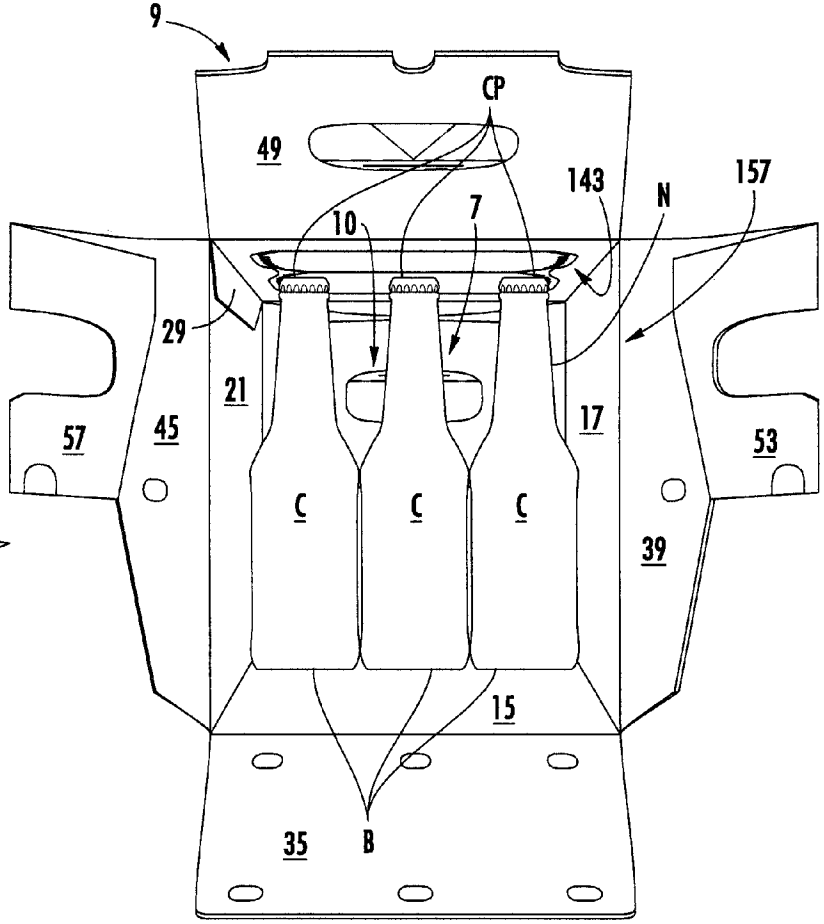
FIGS. 5 and 6 are perspective views of the partially-formed carton according to the first exemplary embodiment of the disclosure.

FIG. 1 is a plan view of the exterior side 1 of a blank, generally indicated at 3, used to form a carton 5 (FIG. 7) according to an exemplary embodiment of the disclosure. The carton 5 can be used to house a plurality of articles such as containers C (FIG. 6). In one embodiment, the containers are bottles having a wide bottom B and a narrow top or neck T including a cap CP. In the illustrated embodiment, the carton 5 is sized to house twelve containers C in a single layer in a 3×4 arrangement, but it is understood that the carton 5 may be sized and shaped to hold containers of a different or same quantity in more than one layer and/or in different row/column arrangements (e.g., 1×6, 2×6, 4×6, 3×8, 2×6×2, 3×4×2, 2×9, 3×6, etc.), or just a single article. In the illustrated embodiment, the carton 5 includes a first end 7 and a second end 9, each with a respective handle, generally indicated at 10 (FIGS. 5-9) for grasping and carrying the carton at each of the ends 7, 9. The carton 5 could have only a single handle 10 or one of the ends 7, 9 could have a handle that is different than the handles 10 without departing from the disclosure. As will be discussed below in more detail, the handles 10 are formed from various features in the carton blank 3.

In one embodiment, the first end 7 and the second end 9 of the carton 5 each have article protection features 11 (FIGS. 5 and 7-9) for protecting at least one article C of the plurality of articles. Additionally, the carton 5 of the first embodiment may have article protection flaps 13 for protecting the at least one article. The article protection features 11 cushion the ends 7, 9 of the carton and prevent or reduce the likelihood of breakage of the containers C. In one embodiment, the article protection flaps 13 are movable between a first position (FIG. 1) and a second position (not shown) placed between adjacent containers C in the carton to reduce movement of the containers in the carton and prevent breakage of the containers. The article protection features and flaps can be similar to, or the same as, those described in U.S. patent application Ser. No. 13/419,740, filed Mar. 14, 2012, the disclosure of which is hereby incorporated by reference for all purposes as if presented herein in its entirety. The article protection features 11 and/or the article protection flaps 13 can be otherwise shaped, arranged, and/or configured without departing from the disclosure. Further, the article protection features 11 and/or article protection flaps 13 can be omitted without departing from the disclosure.

The carton blank 3 has a longitudinal axis L1 and a lateral axis L2. The blank 3 can be generally symmetrical about a longitudinal centerline CL. In the embodiment of FIG. 1, the blank includes a bottom panel 15 foldably connected to a first side panel 17 at a lateral fold line 19. A second side panel 21 is foldably connected to the bottom panel 15 at a lateral fold line 23. A top panel 25 is foldably connected to the first side panel 17 at a lateral fold line 27, and an attachment flap 29 is foldably connected to the top panel 25 at a lateral fold line 31. Any of the top and bottom panels 25, 15, the first and second side panels 17, 21, and the attachment flap 29 could be omitted or could be otherwise shaped, arranged, and/or configured without departing from the disclosure. For example, the blank 3 could include a second top panel foldably connected to the second side panel 21, or the attachment flap 29 could be foldably connected to the second side panel 21 instead of the top panel 25.

The bottom panel 15 is foldably connected to a first bottom end flap 33 and a second bottom end flap 35. The first side panel 17 is foldably connected to a first side end flap 37 and a second side end flap 39. The second side panel 21 is foldably connected to a first side end flap 43 and a second side end flap 45. The top panel 25 is foldably connected to a first top end flap 47 and a second top end flap 49. In one embodiment, when the carton 5 is erected, the end flaps 33, 37, 43, 47 close the first end 7 of the carton, and the end flaps 35, 39, 45, 49 close the second end 9 of the carton. In accordance with an alternative embodiment of the present disclosure, different flap arrangements can be used for closing the ends 7, 9 of the carton 5.

The end flaps 33, 37, 43, 47 extend along a first marginal area of the blank 3, and are foldably connected at a first longitudinal fold line 61 that extends along the length of the blank. The end flaps 35, 39, 45, 49 extend along a second marginal area of the carton blank 3, and are foldably connected at a second longitudinal fold line 63 that also extends along the length of the blank. The longitudinal fold lines 61, 63 may be, for example, substantially straight, or offset at one or more locations to account for blank thickness or for other factors. The ends of the carton 5 could be otherwise shaped, arranged, and/or configured (e.g., at least partially tapered) without departing from the disclosure.

In the illustrated embodiment, reinforcing flaps 51, 53, 55, 57 can be foldably connected to the respective side end flaps 37, 39, 41, 43 along respective transverse fold lines 59. As shown in FIG. 1, the reinforcing flaps 51, 53, 55, 57 are separable from the respective side end flaps 37, 39, 43, 45 along respective cut lines 65, and the reinforcing flaps 51, 55 and 53, 57 are separable from the respective bottom end flaps 33, 35 along respective cut lines 67. In an alternative embodiment, the reinforcing flaps could be spaced apart from the side end flaps and/or the bottom end flaps by openings or gaps or one or more of the cut lines 65, 67 could be replaced by tear lines or other lines of weakening. In one embodiment, the reinforcing flaps 51, 53, 55, 57 can be folded into face-to-face contact with the respective side end flaps 37, 39, 43, 45 (FIG. 3) to reinforce the side end flaps adjacent the handles 10. The reinforcing flaps 51, 53, 55, 57 could be omitted or could be otherwise shaped, arranged, and/or configured without departing from the disclosure.

In the embodiment of FIG. 1, the carton blank 3 has handle features for forming the handles 10. The handle features can include handle flaps 73 foldably connected to a respective top end flap 47, 49 at an arcuate fold line 75 and separable from the respective top end flap 47, 49 along cut lines 74. In one embodiment, additional fold lines 76 can extend in each of the outer handle flaps 73. The handle flaps 73 could be omitted or could be otherwise shaped, arranged, and/or configured without departing from the disclosure.

Figure 3:
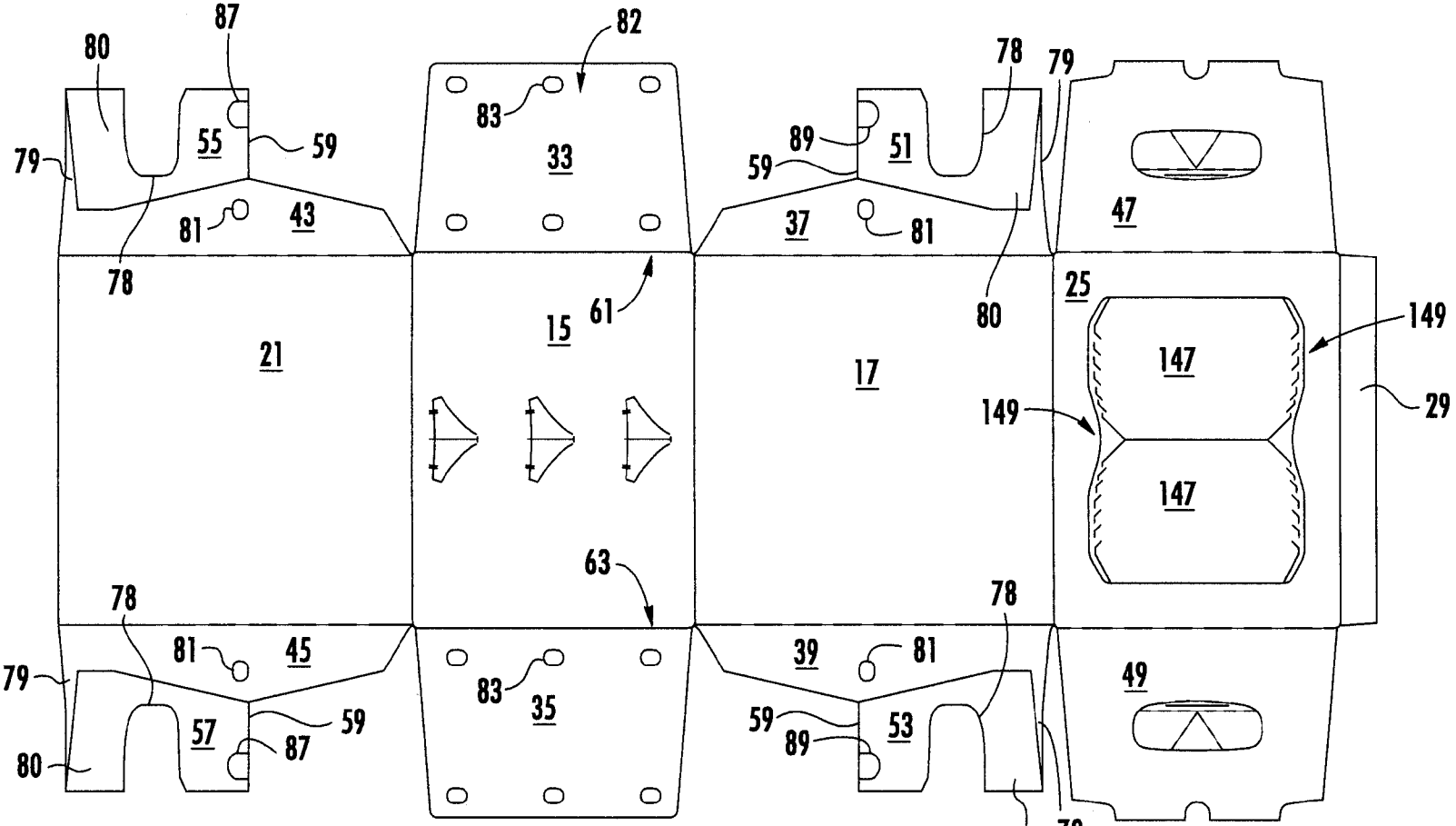
FIG. 3 is an interior plan view of the blank of FIG. 1 with the reinforcing flaps folded with respect to respective side end flaps according to the first exemplary embodiment of the disclosure.
Figure 9:
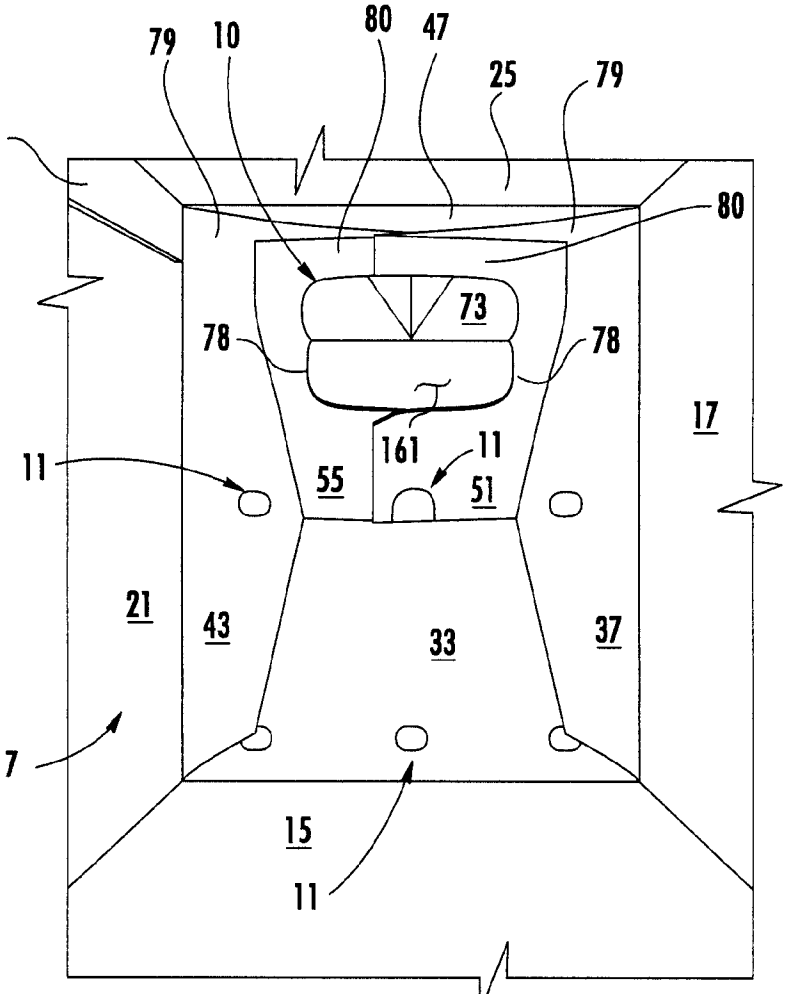
FIGS. 8 and 9 are perspective views of a closed end of the carton of FIG. 7.
Figure 8:
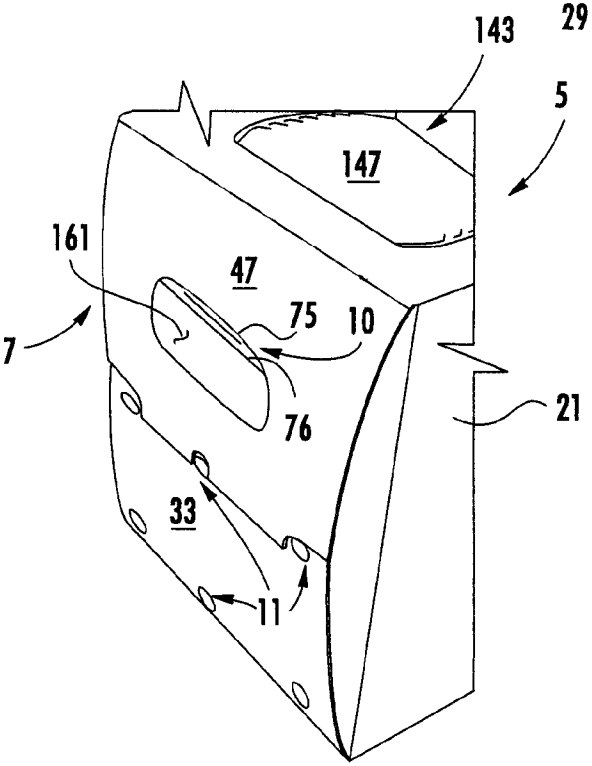

The handle features can also include notches or openings 77 in the side end flaps 37, 39, 43, 45 and notches or openings 78 in the reinforcing flaps 51, 53, 55, 57. The openings 77, 78 cooperate to provide an opening at a respective closed end 7, 9 to allow a respective handle flap 73 to be inwardly folded at the respective end (FIGS. 8 and 9). The side end flaps 37, 39, 43, 45 can also include respective upper portions 79 disposed above the respective openings 77, and the reinforcing flaps 51, 53, 55, 57 can include respective upper portions 80 that are disposed above the respective openings 78 when the reinforcing flaps are upwardly folded (FIG. 3). The blank 3 can have other features for forming the handles 10, or the blank 3 and/or carton 5 can have one or more handles that are alternatively shaped, arranged, and/or configured without departing from the disclosure. For example, either or both of the handle flaps 73 could be omitted. Further, one or both of the handles 10 can be omitted without departing from the disclosure.

Figure 2:
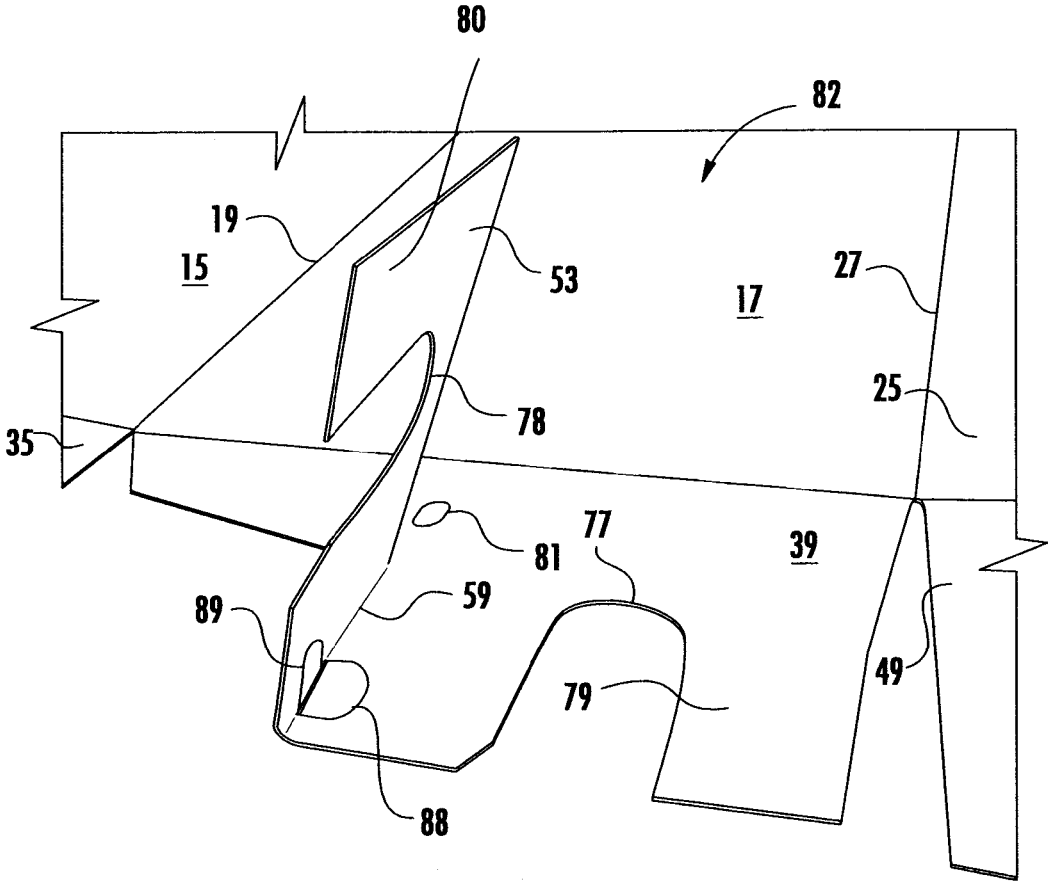
FIG. 2 is a perspective view of the blank of FIG. 1 showing the folding of a reinforcement flap relative to a side end flap according to the first exemplary embodiment of the disclosure.

In one embodiment, the carton blank 3 has features for forming the article protection features 11 of the carton 5. As shown in FIG. 1, the side end flaps 37, 39, 43, 45 have deformations in the form of indentations 81 on the exterior surface 1 of the carton blank 3 such that the indentations from a protrusion on the interior surface 82 of the blank (FIGS. 2 and 3). The bottom end flaps 33, 35 each have two rows of deformations in the form of indentations 83 on the interior surface of the carton blank 3 such that the indentations on the interior surface 82 form respective protrusions on the exterior surface 1 of the carton blank 3. As shown in FIG. 1, the top end flaps 47, 49 each have notches 85. Indentations 87 in the side end flaps 43, 45 and the reinforcing flaps 55, 57 extend over the respective fold lines 59 so that the portions of the indentions 87 in the respective side end flaps 43, 45 overlap the portions of the respective indentions 87 in the respective reinforcing flaps 55, 57 when the reinforcing flaps 55, 57 are folded into face-to-face contact with the side end flaps 43, 45 (FIG. 3). Additionally, an aperture 88 in each of the side end flaps 37, 39 adjacent the respective fold lines 59 is aligned with an indentation 89 in the respective reinforcing flaps 51, 53 so that the aperture 88 and the respective indentations 89 are generally aligned (e.g., the indentation 89 is visible through the aperture 88) when the reinforcing flaps 55, 57 are folded into face-to-face contact with the side end flaps 37, 39 (FIG. 3). Any of the indentations 81, 83, 87, 89 and/or the apertures 88 could be omitted or could be otherwise shaped, arranged, and/or configured without departing from the disclosure. For example, one or more of the indentations 87 could be replaced by an indentation 89 and/or an aperture 88, one or more of the indentations 87 and/or apertures 88 could be replaced by an indentation 87, or one or more of the apertures 88 and indentations 89 could be switched so that the aperture 88 is in the reinforcing flap 51 and/or 53 and the indentation 89 is in the respective side end flap 37, 39.

In one embodiment, when the ends 7, 9 are closed and the side end flaps and bottom end flaps are overlapped, the indentations 87, 89 and the apertures 88 can be aligned with one another and with an indentation 83 in a respective bottom end flap 33, 35 at each end (FIGS. 5 and 7-9). As shown in FIGS. 5 and 7-9, the indentations 81 in the side end flaps 37, 43, 39, 45 can be aligned with respective indentations 83 in the respective bottom end flaps 33, 35 (e.g., the indentations 81, 83 can respectively overlap one another) when the ends 7, 9 of the carton 5 are closed. Additionally, the notches 85 in the top end flaps 47, 49 can be aligned with respective article protection features 11 in the respective closed ends 7, 9 (e.g., respective article protections features 11 can be adjacent a free edge of the top end flaps in a respective notch 85 so that the article protection features are visible through the notches). The indentations 81, 83, 87, 89 can be any deformation on a surface of a respective side end flaps 37, 39, 43, 45, top end flaps 47, 49, or bottom end flaps 33, 35 such that the deformation can be any suitable shape (e.g., a concave depression or protrusion, convex depression or protrusion, flat depression or protrusion, embossed area, debossed area, etc., or any other suitable shape). Furthermore, the indentations 81, 83 could be formed on the interior or exterior surface of one or more of the first side panel 17, second side panel 21, top panel 25, and/or bottom panel 15 without departing from the disclosure.

In the first embodiment, the carton blank 3 includes three article protection flaps 13 arranged in a 1×3 arrangement, but the blank could have more or less than three article protection flaps, and the flaps could be otherwise arranged in other suitable row/column arrangements or in a random configuration on the bottom panel 15, including a single row or single column configuration, or any other suitable configuration. In other embodiments, the carton blank 3 can include article protection flaps that are different, similar, or identical to other article protection flaps without departing from the disclosure. In other embodiments, one or more of the article protection flaps 13 could be omitted or could be otherwise shaped, arranged, and/or configured without departing from the disclosure.

As shown in FIG. 1, the article protection flaps 13 are each foldably connected to the bottom panel 15 at a respective lateral fold line 91 and are each at least partially defined by a cut 93 in the bottom panel. Alternatively, the cut 93 could comprise other forms of weakening (e.g., a tear line that comprises cut lines separated by breakable nicks, a tear line that is formed by a series of spaced apart cuts, etc.) that allow the article protection flap 13 to be separated from the bottom panel 15 without departing from the disclosure. As shown in FIG. 1, the article protection flap 13 can comprise a generally longitudinal fold line 95 extending from the lateral fold line 91. The fold lines 91, 95 and/or the cuts 93 could be omitted or could be otherwise shaped, arranged, and/or configured, such that the article protection flap 13 has any other suitable shape or configuration without departing from the disclosure.

Figure 7:
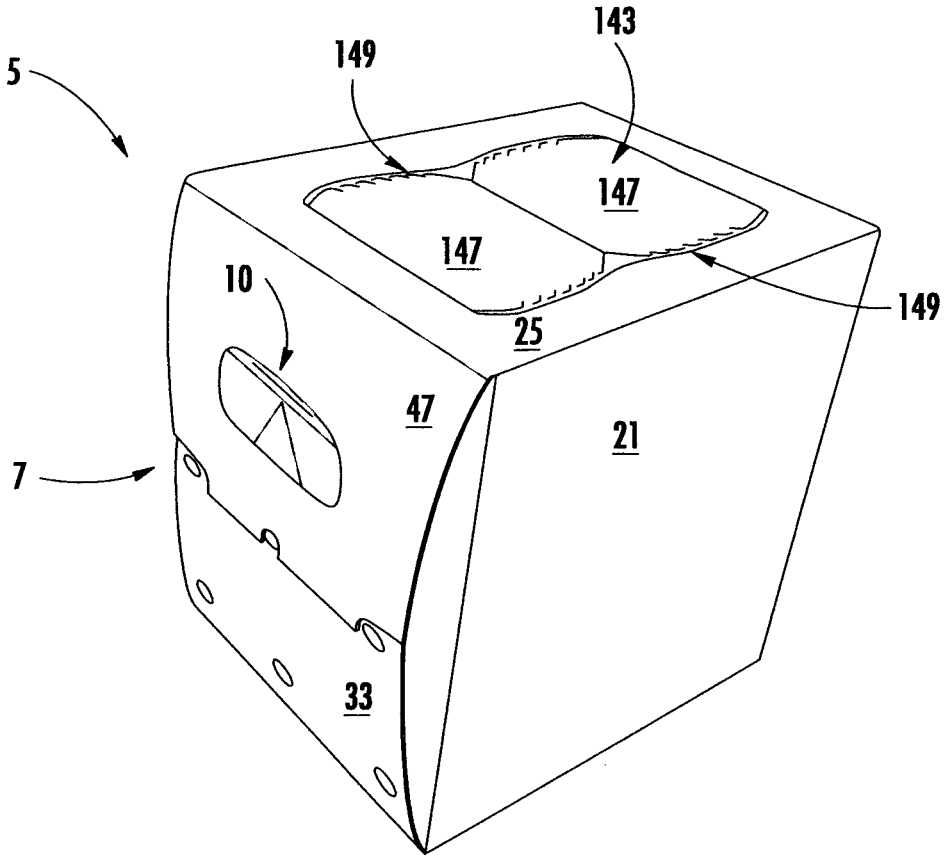
FIG. 7 is a perspective view showing the assembled carton according to the first exemplary embodiment of the disclosure.

As shown in FIG. 1, the blank 3 includes dispenser features for forming a dispenser 143 in the carton 5 (FIG. 7). As shown in FIG. 1, the dispenser features include two dispenser panels 147 that are separable from the remainder of the first top panel 25 along tear lines 149 and are foldably connected to the first top panel 25 along a respective longitudinal fold line 151. The dispenser panels 147 are separable from one another along a longitudinal tear or cut line 153. The dispenser 143, including the dispenser panels 147, the tear lines 149, the fold lines 151, and/or the cut line 153, could be omitted or could be otherwise shaped, arranged, and/or configured without departing from the disclosure.

As shown in FIGS. 2 and 3, the blank 3 can be prepared for forming the carton 5 by folding each of the reinforcing flaps 51, 53, 55, 57 along the respective lateral fold lines 59. For example, reinforcing flap 53 is shown partially folded toward the interior surface 82 of the side end flap 39 in FIG. 2. As shown in FIG. 3, the reinforcing flaps 51, 53, 55, 57 are folded into face-to-face contact with the respective side end flaps 37, 39, 43, 45 so that the upper portions 79, 80 are respectively overlapped with one another generally opposite to the respective fold lines 59 and the openings 77, 78 are respectively aligned with one another. As shown in FIG. 3, the fold lines 59 are spaced below the openings 77, 78. Also, the openings 77, 78 extend from respective outer free edges of the respective side end flaps 37, 39, 43, 45 and reinforcing flaps 51, 53, 55, 57, and the outer free edges are generally aligned with one another (e.g., overlay one another) to extend generally upwardly and downwardly from the openings 77, 78. In the illustrated embodiment, the reinforcing flaps 51, 53, 55, 57 can be glued to the respective side end flaps 37, 39, 43, 45. In an alternative embodiment, the reinforcing flaps could be folded to the exterior of the side end flaps and/or the glue could be omitted from the reinforcing flaps.

Figure 4:
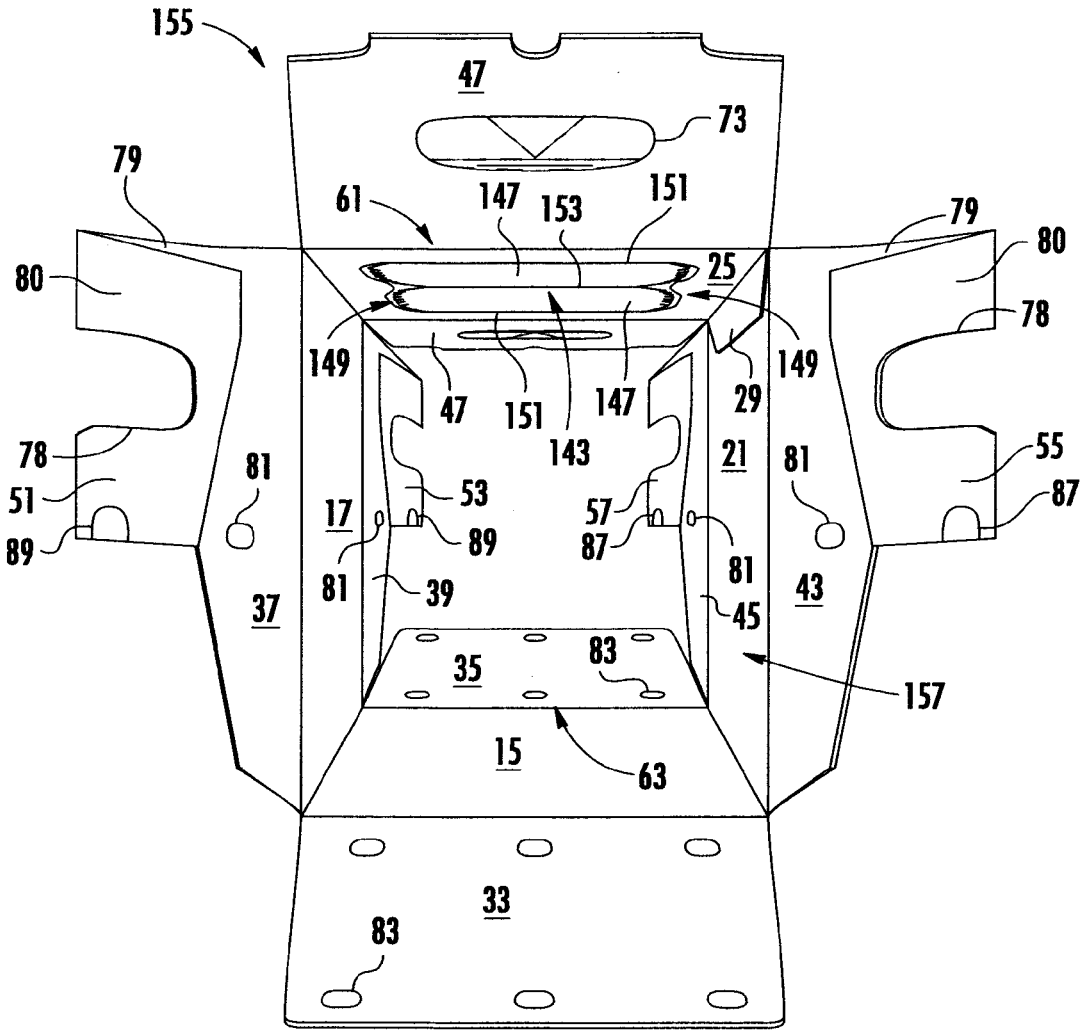
FIG. 4 is a perspective view of an open-ended sleeve formed from the blank of FIG. 1 according to the first exemplary embodiment of the disclosure.

In one exemplary embodiment, the carton 5 can be assembled further by folding the top panel 25 along the transverse fold line 27 so that the top panel 25 overlaps the interior surface 82 of the first side panel 17 and folding the second side panel 21 along the transverse fold line 23 to overlap the bottom panel 15 and the attachment flap 29. The attachment flap can be glued to the second side panel 21. The carton can be further assembled by folding the blank 3 along the transverse fold lines 19, 23, 27, 31 to form an open-ended sleeve 155 with an interior 157 (FIG. 4). As shown in FIG. 6, the containers C can be loaded into the interior 157 of the open-ended sleeve 155 before or after closing either of the ends 7, 9. Only three of the containers C have been loaded into the interior 157 in FIG. 6 for the purpose of illustration. The blank 3 may be otherwise formed into the open-ended sleeve using alternative folding and gluing steps without departing from the scope of this disclosure. Additionally, the containers C could be otherwise loaded into the interior 157 of the open-ended sleeve 155 without departing from the scope of this disclosure.

Figure 5:
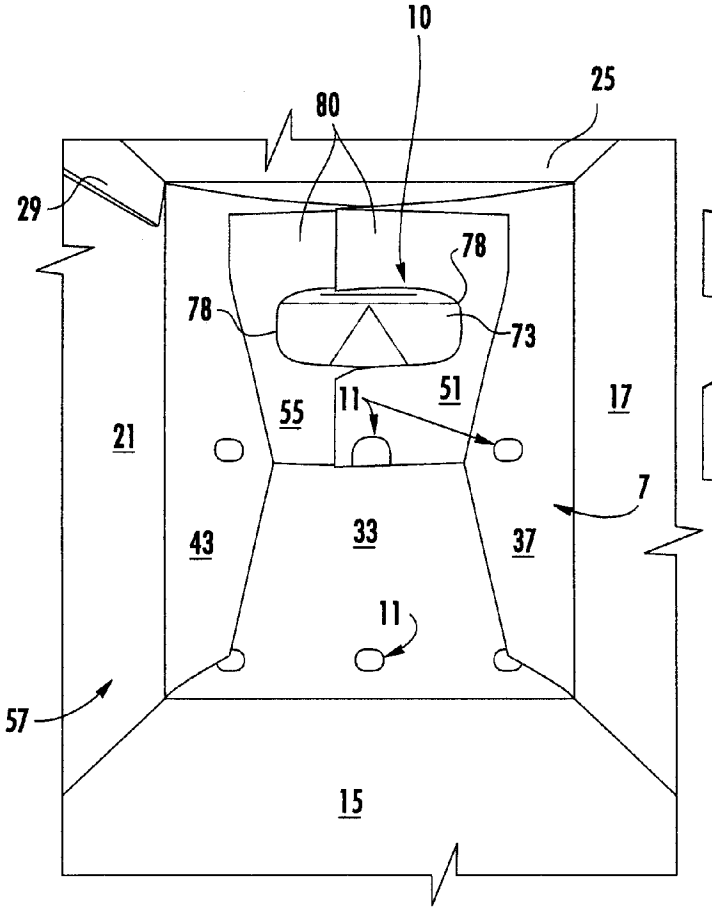

In the illustrated embodiment, the side end flaps 37, 43 are inwardly folded along the longitudinal fold line 61 to at least partially close the first end 7. In one embodiment, the bottom end flap 33 is folded upwardly along the longitudinal fold line 61 into face-to-face contact with the lower portions of the side end flaps 37, 43, and the top end flap 47 is folded along the longitudinal fold line 61 so that the top end flap 47 overlaps the side end flaps 37, 43 and the handle flap 73 is generally aligned with the openings 77. The top end flap 47 also can at least partially overlap the bottom end flap 33 and can be glued in face-to-face contact with the side end flaps 37, 43 and/or the bottom end flap 33. Accordingly, the handle 10 (FIGS. 5 and 7-9) in the first end 7 is formed by the alignment of the handle flap 73 of the top end flap 47, the openings 77 of the side end flaps 37, 43, and the openings 78 of the reinforcing flaps 51, 55. The top end flap 47, the side end flaps 37, 43, and the bottom end flap 33 can be selectively adhered to one another to close the first end 7 of the carton 5 (FIGS. 5-7).

In one embodiment, the second end 9 of the carton 5 can be closed in a similar manner as the first end 7 by folding, respectively overlapping, and selectively adhering the side end flaps 39, 45, the top end flap 49, and the bottom end flap 35. The erected carton is shown in FIG. 7. One or both of the ends 7, 9 could be otherwise shaped, arranged, configured, or omitted, without departing from the disclosure. Accordingly, the open-ended sleeve 155 can be alternatively loaded with containers and closed without departing from the disclosure. For example, the ends 7, 9 can be closed in any order, and the containers could be loaded before or after closing either or both of the ends 7, 9. Additionally, the reinforcing flaps 51, 53, 55, 57 could be folded along respective fold lines 59 and/or glued before or after any step of forming the carton 5.

In the exemplary embodiment, the handle 10 in the first end 7 can be actuated as shown in FIGS. 8 and 9. Accordingly, the handle flap 73 can be folded inwardly along the fold lines 75, 76 through the openings 77, 78 in the side end flaps 37, 43 and reinforcing flaps 51, 55 to form a handle opening 161.

In the illustrated embodiment, the reinforcing flaps 51, 53, 55, 57 can help reinforce the closed ends 7, 9 of the carton 5 at the handles 10. For example, as shown in FIG. 6, the top end flap 47, the upper portions 79 of the side end flaps 37, 43, and the upper portions 80 of the reinforcing flaps 51, 55 can provide five layers of material above the handle 10 where the side end flaps 37, 43 overlap in the first closed end 7. Additionally, there can be six layers of material reinforcing the closed end 7 above the handle 10 when the handle flap 73 is folded inwardly and upwardly against the upper portions 80 of the reinforcing flaps 51, 55 as shown in FIG. 9.

Figure 10:
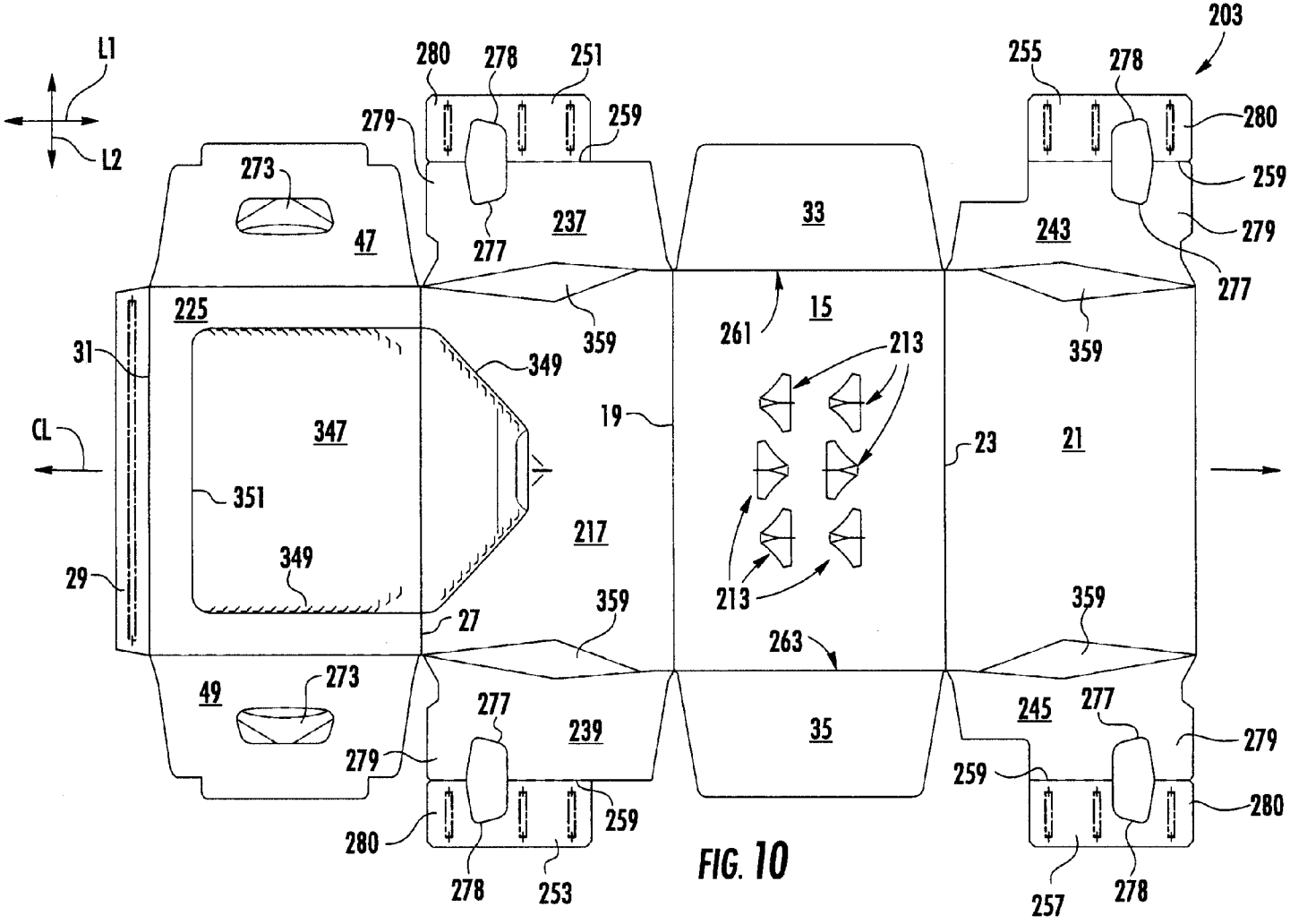
FIG. 10 is an exterior plan view of a blank used to form a carton according to a second exemplary embodiment of the disclosure.

FIG. 10 is a plan view of a blank 203 for forming a carton 205 (FIG. 15) of a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 10, the reinforcing flaps 251, 253, 255, 257 are foldably connected to the respective side end flaps 237, 239, 243, 245 along respective longitudinal fold lines 259. In the third embodiment, the openings 277 in the side end flaps 237, 239, 243, 245 are aligned with the respective openings 278 in the respective reinforcing flaps 251, 253, 255, 257, so that the respective openings 277, 278 form continuous openings that interrupt the respective longitudinal fold lines 259. Accordingly, the fold lines 259 extend generally upwardly and downwardly from the edges of the openings 277, 278. As shown in FIG. 10, the upper portions 279 of the respective side end flaps 237, 239, 243, 245 are foldably connected to the respective upper portions 280 of the respective reinforcing flaps 251, 253, 255, 257. Any of the side end flaps 237, 239, 243, 245 and/or the reinforcing flaps 251, 253, 255, 257 could be omitted or could be otherwise shaped, arranged, and/or configured without departing from the disclosure.

In the illustrated embodiment, the blank 203 can include six article protection flaps 213 in a 2×3 arrangement in the bottom panel 15, and the dispenser panel 347 and the tear lines 349 can extend in the top panel 225 and into the first side panel 217. As shown in FIG. 10, the top panel 225 is generally shorter than the bottom panel 15 in the lateral L2 direction and the side end flaps 237, 239, 243, 245 can be foldably connected to the respective side panels 217, 21 by respective diamond corner panels 359. Accordingly, the closed ends 207, 209 and/or the side panels 217, 21 of the carton 205 can at least partially taper inwardly adjacent the top panel 225 to help retain the narrower top portions N of the containers C. The article protection flaps 213, the dispenser panel 347, and/or the diamond corner panels 359 could be omitted or could be otherwise shaped, arranged, and/or configured without departing from the disclosure. Additionally, the blank 203 could be otherwise shaped, arranged, and/or configured without departing from disclosure.

Figure 11:
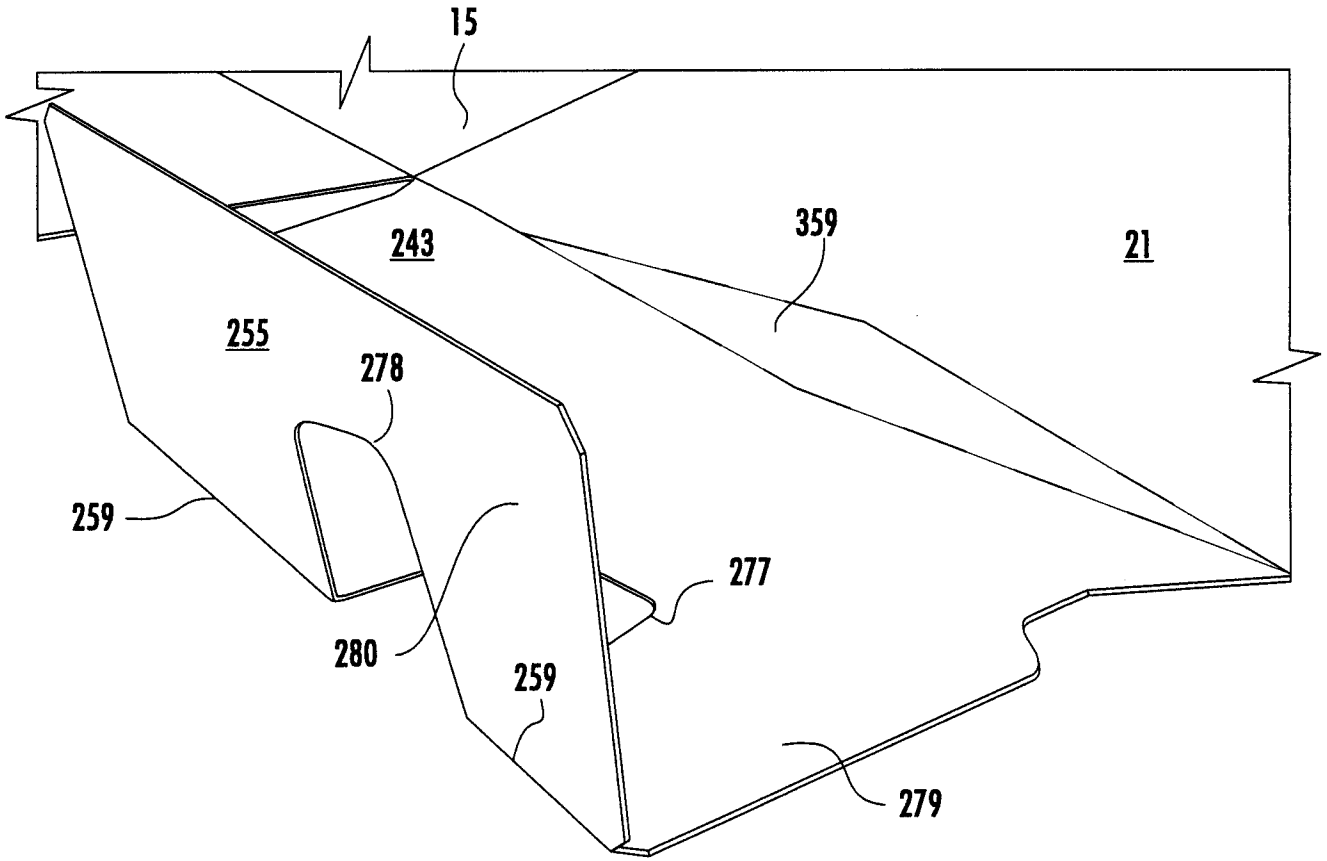
FIG. 11 is a perspective view of the blank of FIG. 10 showing the folding of a reinforcement flap relative to side end flap according to the second exemplary embodiment of the disclosure.
Figure 12:
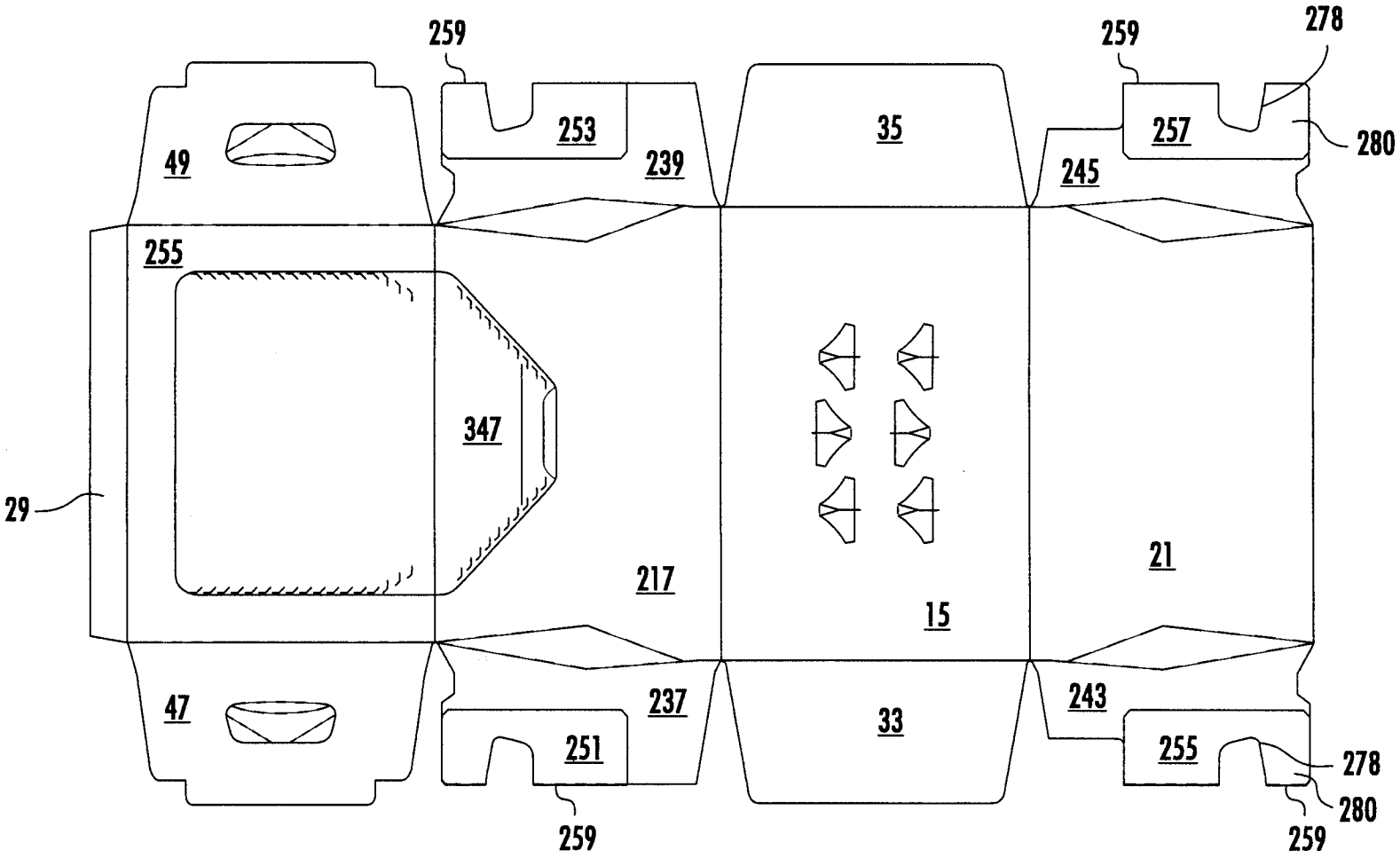
FIG. 12 is an interior plan view of the blank of FIG. 10 with the reinforcing flaps folded with respect to respective side end flaps according to the second exemplary embodiment of the disclosure.

As shown in FIGS. 11 and 12, the reinforcing flaps 251, 253, 255, 257 can be folded along the respective longitudinal fold lines 259 and glued and/or otherwise secured in face-to-face contact with an interior surface of the respective side end flaps 237, 239, 243, 245 so that the upper portions 279, 280 are overlapped with respect to one another, and the openings 277, 278 are generally aligned. Alternatively, the reinforcing flaps could be glued to the exterior surface of the respective side end flaps.

Figure 13:
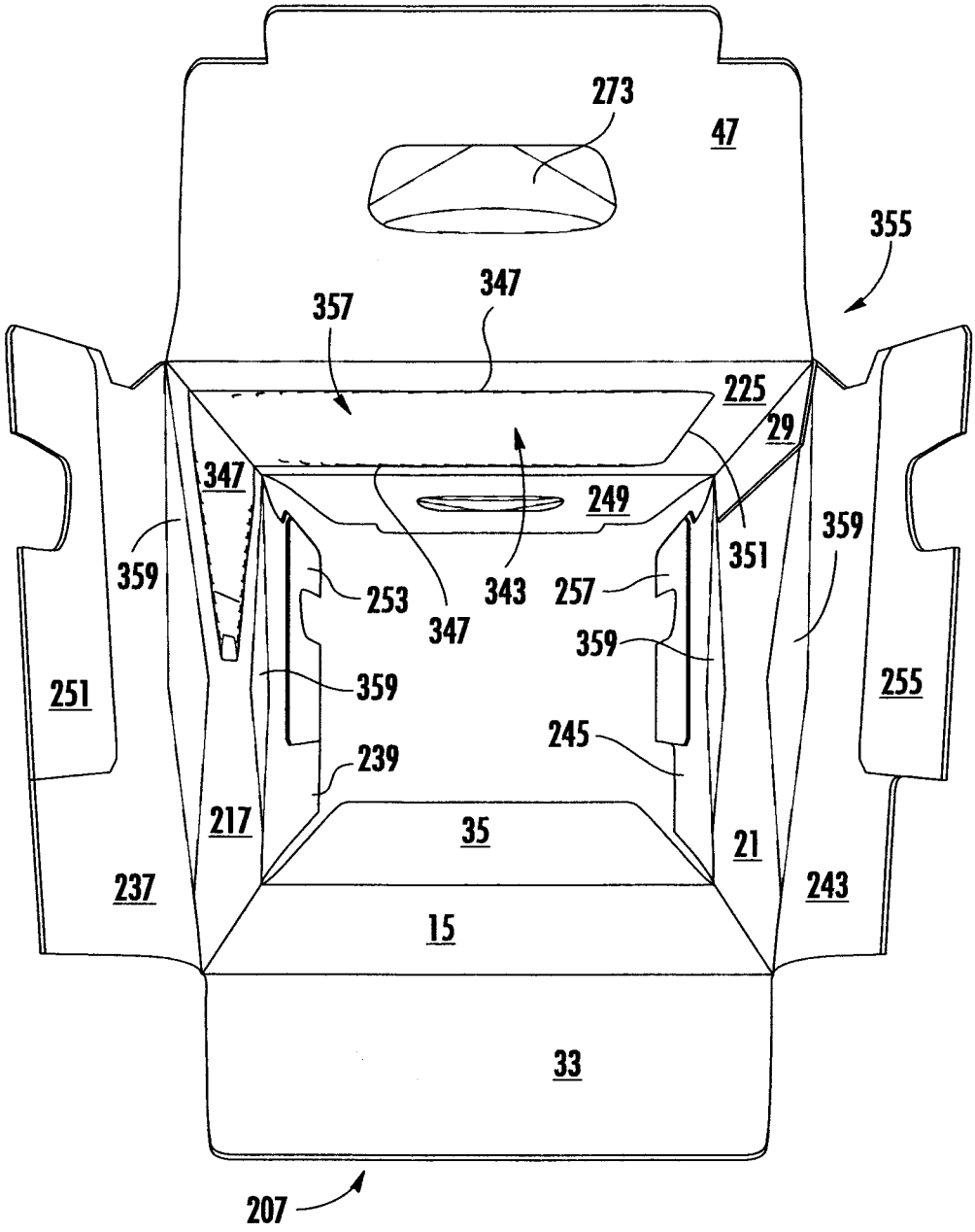
FIG. 13 is a perspective view of an open-ended sleeve formed from the blank of FIG. 10 according to the second exemplary embodiment of the disclosure.
Figure 14:
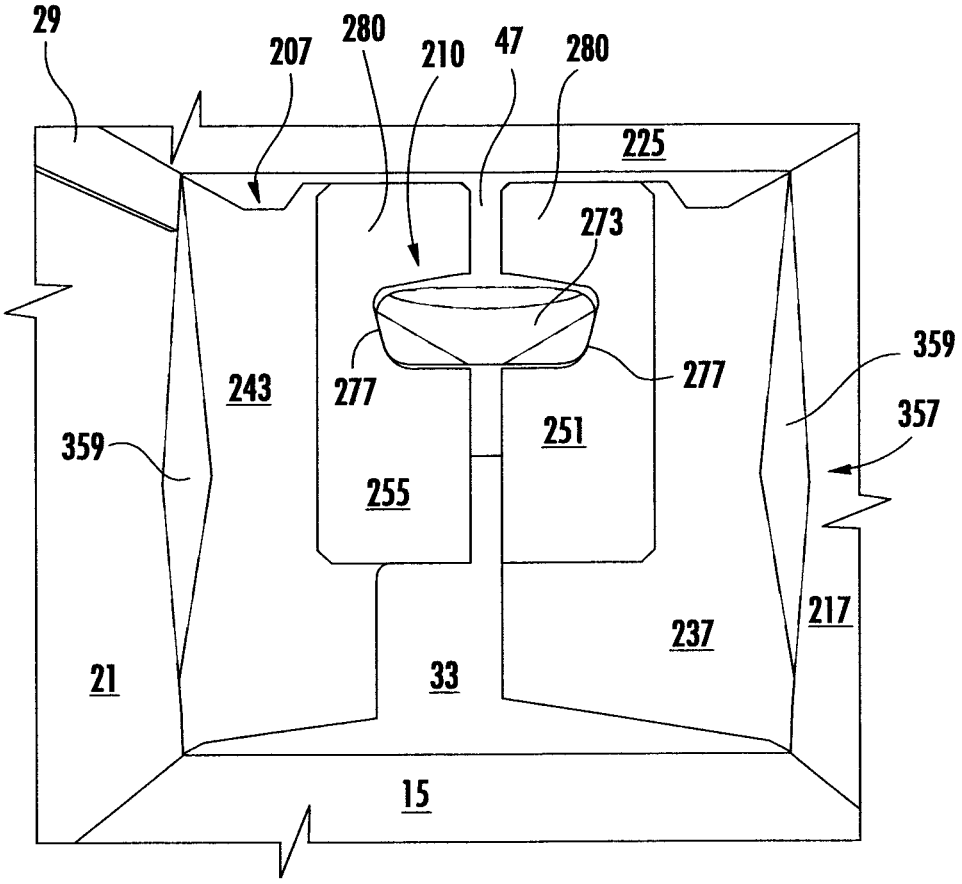
FIG. 14 is a perspective view of the partially-formed carton according to the second exemplary embodiment of the disclosure.
Figure 15:
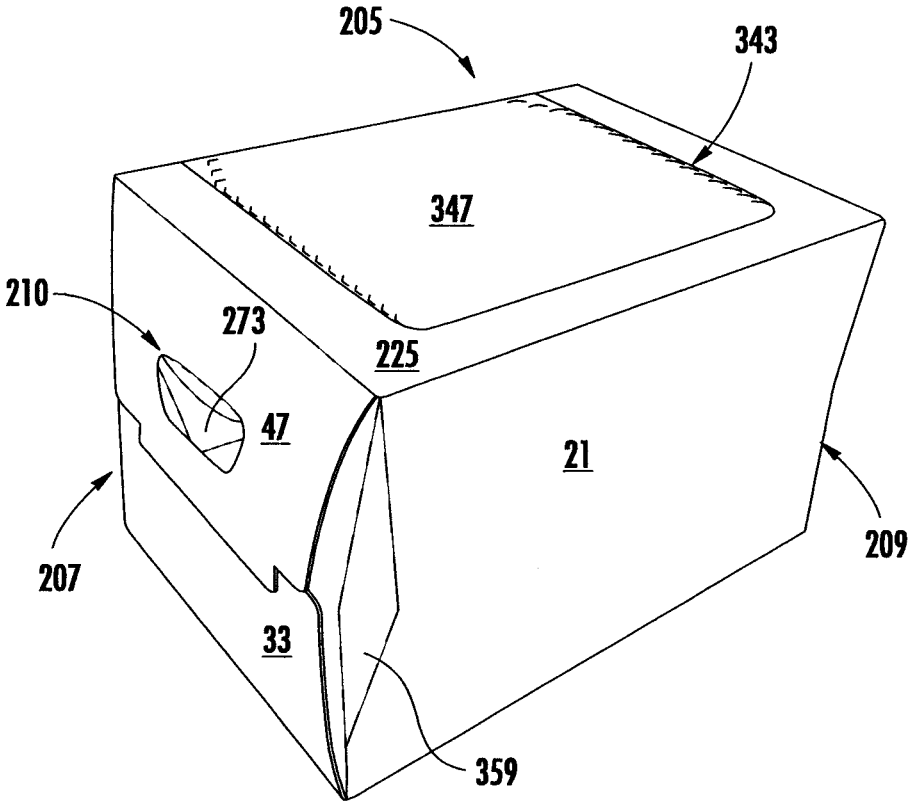
FIG. 15 is a perspective view showing the assembled carton according to the second embodiment of the disclosure.

In one embodiment, the carton 205 can be formed from the blank 203 and the ends 207, 209 can be closed as shown in FIGS. 13-15, similarly as the formation of the carton 5 from the blank 3 in the first embodiment. As shown in FIG. 13, the blank 203 can be formed into an open-ended sleeve 355 with an interior 357. As shown in FIG. 14, the closed first end 207 is formed by folding the side end flaps 237, 243 over the end of the open-ended sleeve 355 and folding the bottom end flap 33 and the top end flap 47 to overlap the side end flaps 237, 243. In the illustrated embodiment, the top end flap 47 overlaps the side end flaps 237, 243 at the first end 207 so that the handle flap 273 is aligned with the openings 277, 278 in the side end flaps 237, 243 and the reinforcing flaps 251, 255. Accordingly, portions of the closed end 207 have three layers of material, including the upper portions 279, 280 of the side end flaps 237, 243 and the reinforcing flaps 251, 255 and the top panel 47, over the handle 210 for reinforcing the handle. In an alternative embodiment, the side end flaps 237, 243 can at least partially overlap so that there are additional layers of material above the handle 210. When the handle flap 273 is folded inwardly to actuate the handle 210, the closed end 207 can have an additional layer (e.g., four) above the handle 210. The containers C can be loaded into the carton before or after closing either of the ends 207, 209. The carton 205 could be otherwise formed using alternative folding and/or gluing steps without departing from the scope of this disclosure.

Figure 16:
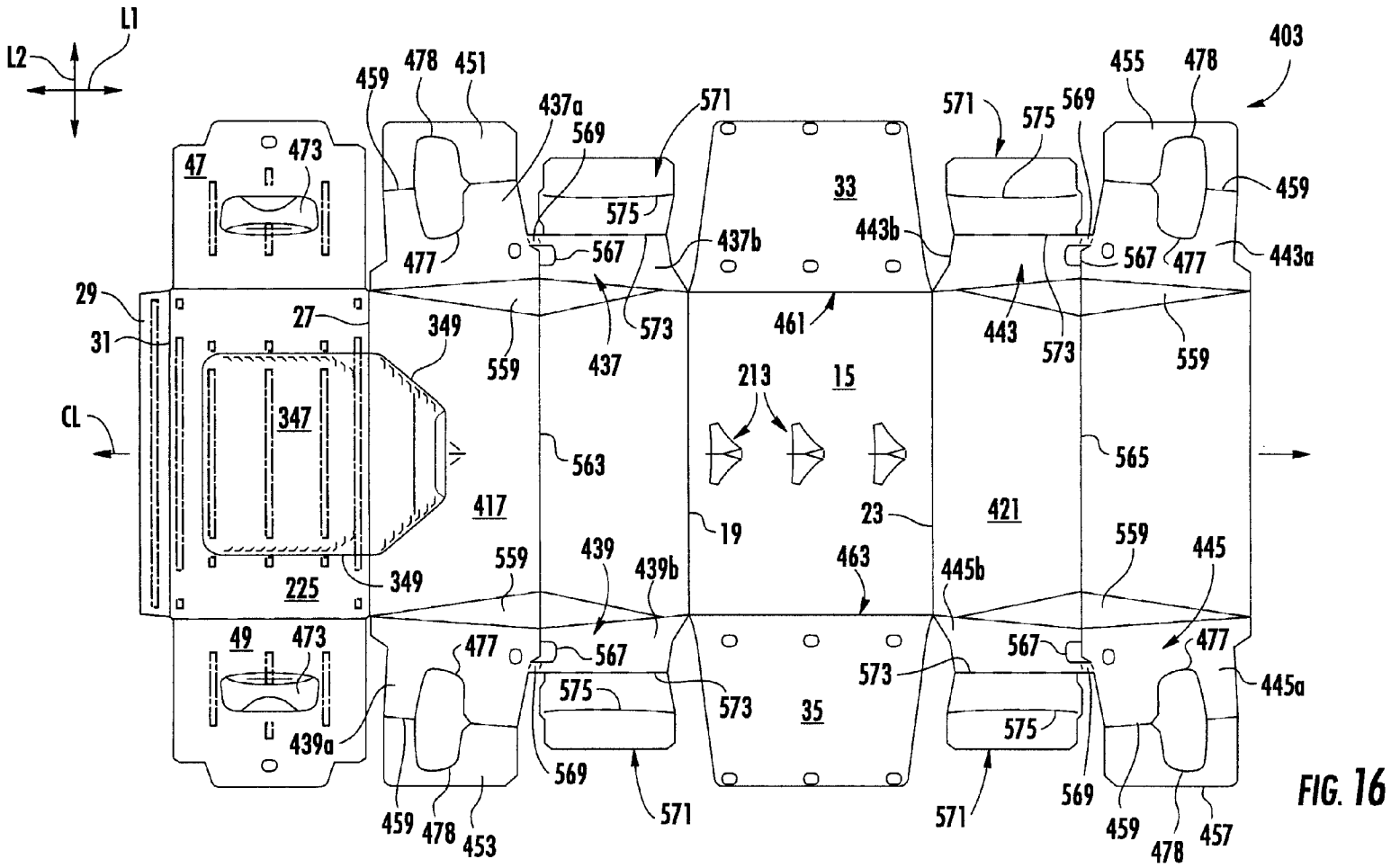
FIG. 16 is an exterior plan view of a carton blank used to form a carton according to a third exemplary embodiment of the disclosure.

FIG. 16 is a plan view of a blank 403 for forming a carton 405 (FIG. 22) of a third embodiment of the disclosure. The third embodiment is generally similar to the first embodiment, except for variations noted and variations that will be apparent to one of ordinary skill in the art. Accordingly, similar or identical features of the embodiments have been given like or similar reference numbers. As shown in FIG. 16, the blank 403 includes lateral fold lines 563, 565 extending across the respective side panels 417, 421 and the diamond corner panels 559, dividing the side panels and the diamond corner panels into upper and lower portions. Additionally, the side end flaps 437, 439, 443, 445 include respective upper flaps 437*a*, 439*a*, 443*a*, 445*a* and lower flaps 437*b*, 439*b*, 443*b*, 445*b* separated by respective openings 567 and connected at respective connector panels 569 (e.g., at respective fold lines). The top panel 225 generally is smaller than the bottom panel 15 and the upper portions of the sides and ends of the carton 405 can taper inwardly toward the top of the carton to help retain the narrow upper portions N of the containers C.

As shown in FIG. 16, reinforcing flaps 451, 453, 455, 457 are foldably connected to the respective upper flaps 437*a*, 439*a*, 443*a*, 445*a* along respective fold lines 459 and cooperate with the upper portions in a similar manner as the reinforcing flaps 251, 253, 255, 257 and side end flaps 237, 239, 243, 245 of the second embodiment to reinforce the handles 410 of the carton 405.

In the illustrated embodiment, a corner flap 571 (e.g., corner cushion) can be foldably connected to each of the lower flaps 437*b*, 439*b*, 443*b*, 445*b* of the respective side end flaps 437, 439, 443, 445. In one embodiment, the corner flaps 571 can be similar or identical to the corner flaps 101 shown and described in U.S. patent application Ser. No. 13/833,542, filed Mar. 15, 2013, the disclosure of which is hereby incorporated by reference as if presented herein in its entirety. The corner flaps 571 can help secure the containers C in the carton 405, help cushion the containers C, and/or help reinforce the respective corners of the carton. Each of the corner flaps 571 can be foldably connected to the respective side end flap along a longitudinal fold line 573 and can include an intermediate fold line 575. In one embodiment, the intermediate fold line 575 can be generally arcuate, as shown in FIG. 16. Alternatively, the fold lines 575 could be generally straight or otherwise shaped. Accordingly, each of the corner flaps 571 can be folded and positioned generally proximate or adjacent a respective corner (e.g., adjacent the fold lines 461, 463) of the carton 405 (FIG. 22) to at least partially conform to the shape of the containers C adjacent the corners and to help reduce the freedom of movement of the corner containers. The corner flaps 571 could be otherwise shaped, arranged, and/or configured without departing from the disclosure. Additionally, the carton can have a different number of corners than corner flaps 571.

The blank 403 could be otherwise shaped, arranged, and/or configured without departing from disclosure.

Figure 17:
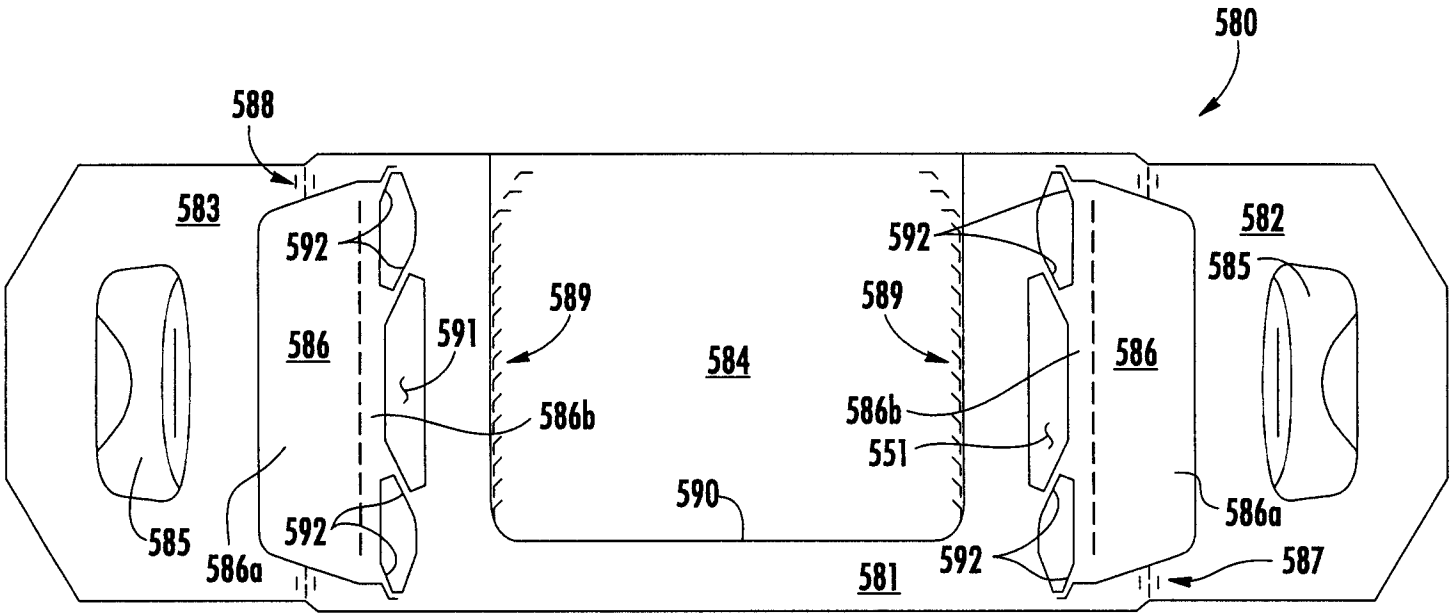
FIG. 17 is a plan view of an optional insert for reinforcing the carton formed from the blank of FIG. 16.

As shown in FIG. 17, an optional insert 580 can include a central panel 581 foldably connected to respective reinforcing flaps 582, 583 along respective fold lines or fold areas 587, 588. A dispenser panel 584 can extend in the central panel 581 for being overlapped by the dispenser panel 347 in the top panel 225. In the illustrated embodiment, the dispenser panel 584 is at least partially defined by two tear lines 589 and a fold line 590. Respective handle flaps 585 can extend in the respective reinforcing flaps 582, 583 for being overlapped by the respective handle flaps 473 in the top end flaps 47, 49 when the handles 410 are formed. Crown retention flaps 586 can extend in the central panel 581 and the reinforcing flaps 582, 583. As shown in FIG. 17, the crown retention flaps 586 are separable from the central panel 581 and the reinforcing flaps 582, 583 by cut and/or tear lines. In one embodiment, the crown retention flaps 586 can be foldably connected to the respective reinforcing flaps 582, 583 along respective fold lines. As shown in FIG. 17, the crown retention flaps each can include a first portion 586*a* and a second portion 586*b* connected along a fold line.

Figure 20:
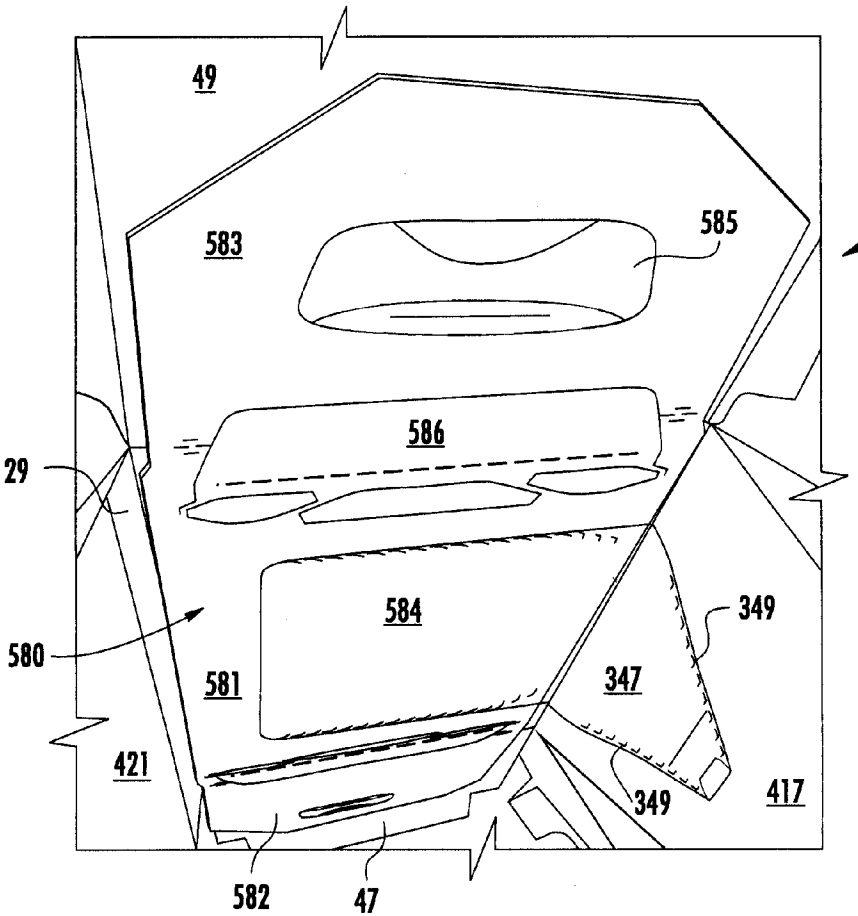

Each of the crown retention flaps 586 can be partially spaced from the central panel 581 by an opening 591, and the second portions 586*b* of the crown retention flaps 586 can be at least partially connected to the central panel by four collapsible nicks 592. In one embodiment, the insert 580 can be glued or otherwise secured to the blank 403 before or during the formation of the carton 405 so that the top panel 225 overlaps the central panel 581 and the top end flaps 47, 49 overlap the respective reinforcing flaps 582, 583 (e.g., FIG. 20). The insert 580 could be omitted or could be otherwise shaped, arranged, and/or configured without departing from disclosure.

Figure 18:
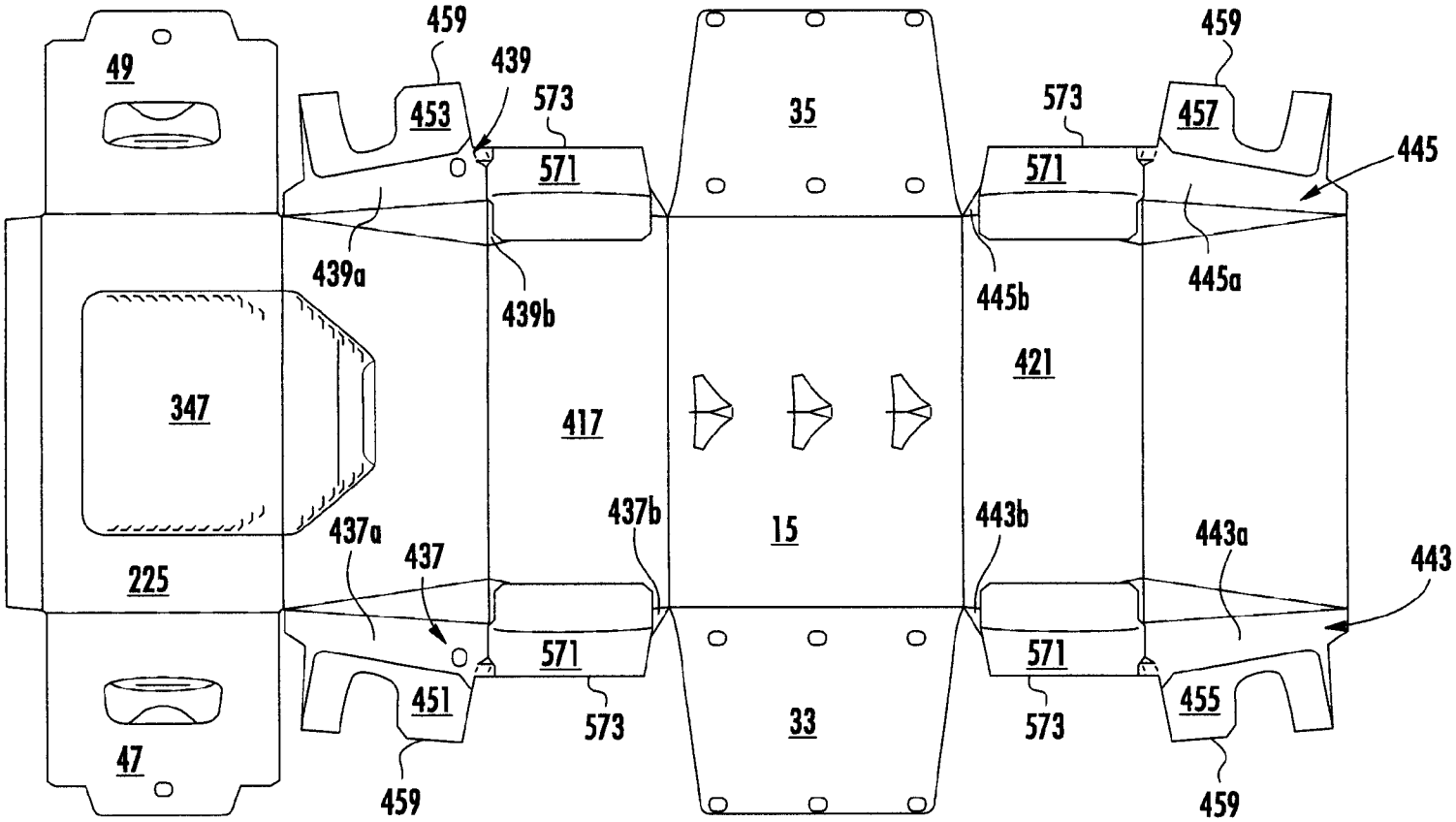
FIG. 18 is an interior plan view of the blank of FIG. 16 with reinforcing flaps and corner flaps folded with respect to respective side end flaps according to the third exemplary embodiment of the disclosure.
Figure 19:
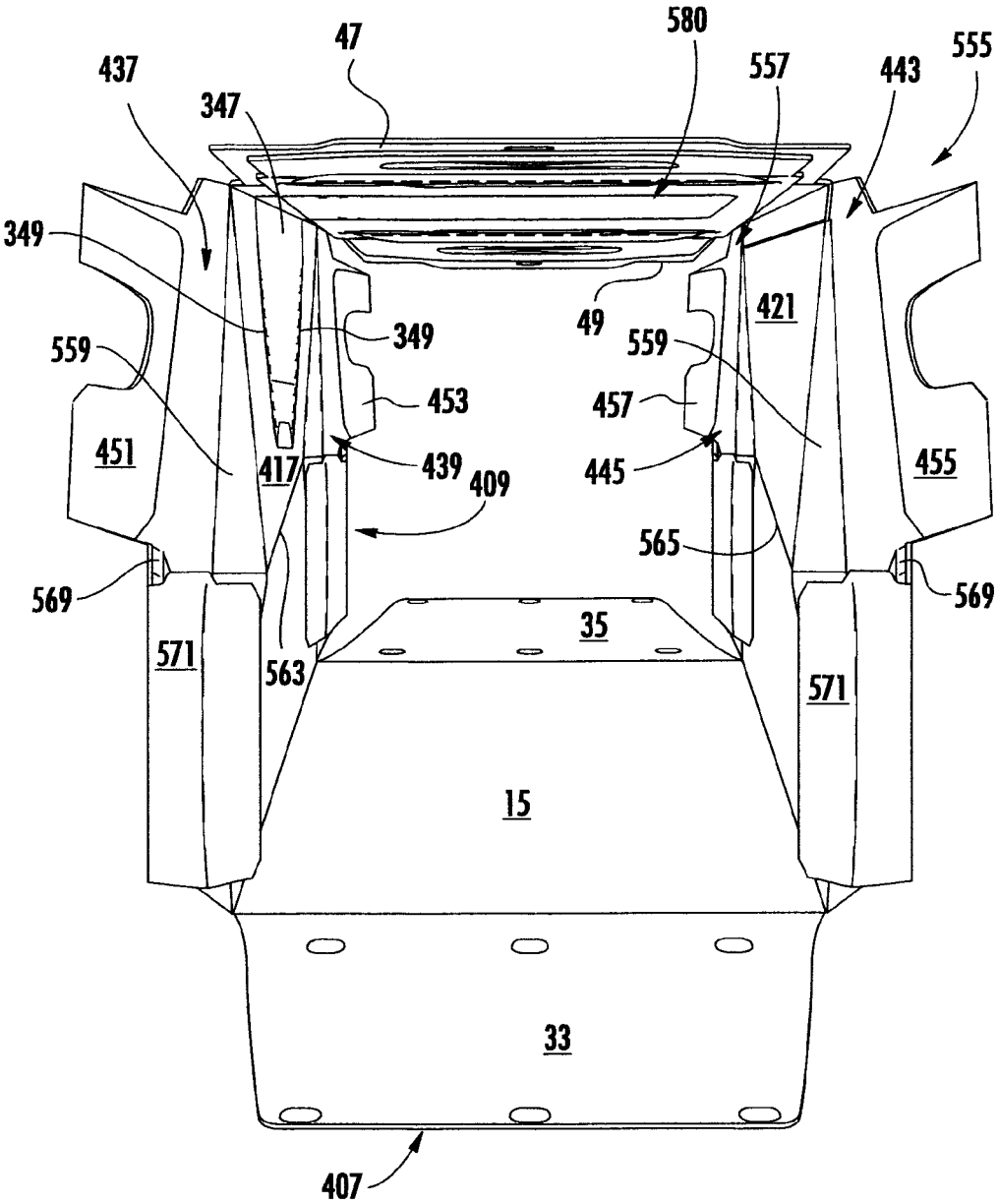
FIGS. 19 and 20 are perspective views of an open-ended sleeve formed from the blank of FIG. 16 according to the third exemplary embodiment of the disclosure.
Figure 21:
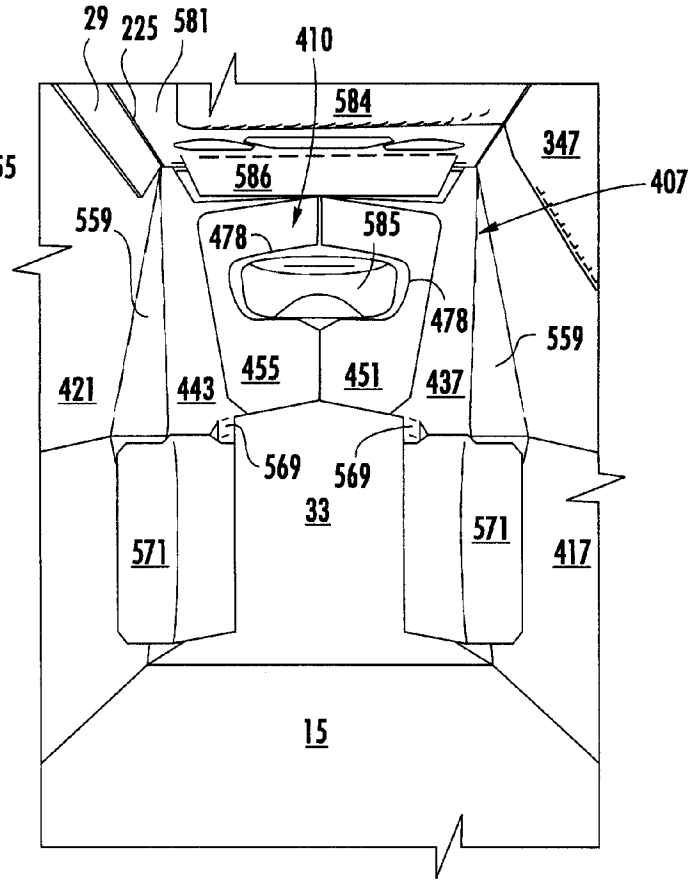
FIG. 21 is a perspective view of the partially-formed carton according to the third exemplary embodiment of the disclosure.
Figure 22:
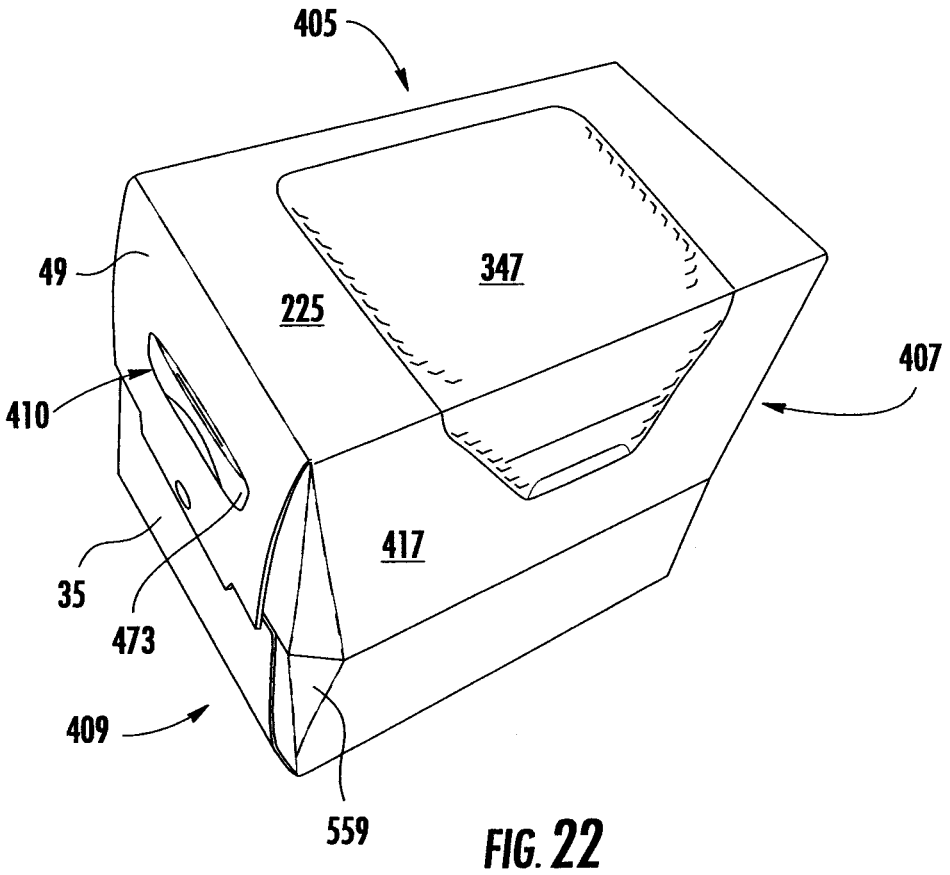
FIG. 22 is a perspective view showing the assembled carton according to the third embodiment of the disclosure.

The carton 405 can be formed, in one embodiment, by folding the reinforcing flaps 451, 453, 455, 457 along the respective fold lines 459 into face-to-face contact with the respective upper flaps 437*a*, 439*a*, 443*a*, 445*a* of the respective side end flaps 437, 439, 443, 445 as shown in FIG. 18. Additionally, the corner flaps 571 can be folded along the respective fold lines 573 into face-to-face contact with the respective lower flaps 437*b*, 439*b*, 443*b*, 445*b* of the respective side end flaps 437, 439, 443, 445. The blank 403 can be folded along the fold lines 563, 565 in the side panels 417, 421 so that the attachment flap 29 can be glued to the interior surface of the second side panel 421. As shown in FIG. 19, the open-ended sleeve 555 can be formed by folding along the fold lines 19, 23, 27, 31, 563, 565. As shown in FIG. 21, the first end 407 can be closed by folding the side panel flaps 437, 443 over the first end 407 so that the corner flaps 571 extend in the corners of the carton (e.g., adjacent the fold lines 461, 463). The bottom end flap 33, the reinforcing flap 582, and the top end flap 47 can be folded over the side end flaps 437, 443 as shown in FIGS. 21 and 22. The handle flaps 483, 585 can be aligned with the openings 477, 478 to form the handle 410 in the closed end 407 as shown in FIG. 21. The second end 409 can be similarly closed. The erected carton 405 is shown in FIG. 22. The carton 405 could be otherwise formed using alternative folding and gluing steps without departing from the scope of this disclosure.

Any of the features of the various embodiments of the disclosure can be combined with, replaced by, or otherwise configured with other features of other embodiments of the disclosure without departing from the scope of this disclosure. Further, it is noted that the reinforcing flaps and/or corner flaps of the various embodiments can be incorporated into a carton having any carton style or panel configuration. The carton styles and panel configurations described above are included by way of example.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of articles, the carton comprising:

a plurality of panels that extends at least partially around an interior of the carton, the plurality of panels comprising at least a top panel and a side panel;

a plurality of end flaps respectively foldably connected to respective panels of the plurality of panels, the plurality of end flaps being at least partially overlapped with respect to one another to thereby at least partially form a closed end of the carton, the plurality of end flaps comprising at least a side end flap foldably connected to the side panel along a first fold line;

a handle in the closed end of the carton for grasping and carrying the carton, the handle extending in at least the side end flap; and a reinforcing flap foldably connected to the side end flap along a second fold line, the reinforcing flap at least partially overlapping the side end flap for reinforcing the handle, a portion of the side end flap having a free edge that is collinear with the second fold line, the handle comprises a first opening in the side end flap and a second opening in the reinforcing flap, and the first opening and the second opening are generally aligned with one another in the closed end, and the side end flap comprises an upper edge and a lower edge opposite the upper edge and the second fold line extends from the upper edge and the lower edge, and the second fold line is interrupted by the first opening and the second opening so that the second fold line extends generally upwardly and downwardly from the first opening and the second opening.

2. The carton of claim 1, wherein the reinforcing flap is at least partially in face-to-face contact with the side end flap above the first opening and the second opening.

3. The carton of claim 1, wherein the second fold line extends from an edge of the first opening and the second opening.

4. The carton of claim 1, wherein a first upper portion of the side end flap is foldably connected to a second upper portion of the reinforcing flap, and the first upper portion is at least partially in face-to-face contact with the second upper portion above the first opening and the second opening.

5. The carton of claim 4, wherein the reinforcing flap is foldably connected to and at least partially in face-to-face contact with the side end flap below the first opening and the second opening.

6. The carton of claim 1, wherein the side end flap comprises an upper flap and a lower flap, and the reinforcing flap is foldably connected to the upper flap along the second fold line.

7. The carton of claim 6, wherein the upper flap is connected to the lower flap by at least a connector panel.

8. The carton of claim 6, further comprising a corner flap foldably connected to the lower flap of the side end flap, the corner flap being folded with respect to the side end flap to extend adjacent a corner of the carton.

9. The carton of claim 1, further comprising an article protection feature in the closed end of the carton, the article protection feature comprising at least a deformation extending in at least the reinforcing flap.

10. The carton of claim 9, wherein the deformation further extends in the side end flap and the second fold line extends at least partially across the deformation.

11. The carton of claim 9, wherein the article protection feature further comprises an aperture in the side end flap adjacent the deformation in the reinforcing flap, the aperture interrupting the second fold line.

12. The carton of claim 11, wherein:

the side panel is a first side panel, the side end flap is a first side end flap, the reinforcing flap is a first reinforcing flap, and the deformation is a first deformation;

the plurality of panels comprises a second side panel, the plurality of end flaps comprises a second side end flap foldably connected to the second side panel, and a second reinforcing flap is foldably connected to the second side flap; and the article protection feature comprises a second deformation extending in the second reinforcing flap and the second side end flap, the first side end flap and the first reinforcing flap at least partially overlapping the second side end flap and the second reinforcing flap so that the first deformation, the second deformation, and the aperture are generally aligned in the closed end of the carton.

13. The carton of claim 1, wherein:

the side panel is a first side panel, the side end flap is a first side end flap, and the reinforcing flap is a first reinforcing flap;

the plurality of panels comprises a second side panel, the plurality of end flaps comprises a second side end flap foldably connected to the second side panel, and a second reinforcing flap is foldably connected to the second side flap along a third fold line; and the handle further extends in the second side end flap and the second reinforcing flap, the second reinforcing flap at least partially overlapping the second side end flap for reinforcing the handle.

14. The carton of claim 13, wherein the handle comprises a handle opening extending in the first side end flap, the second side end flap, the first reinforcing flap, and the second reinforcing flap.

15. The carton of claim 14, wherein the plurality of end flaps further comprises a top end flap foldably connected to the top panel, the handle further comprises a handle flap foldably connected to the top end flap, the top end flap at least partially overlaps the first side end flap and the second side end flap, and the handle flap is generally aligned with the handle opening.

16. The carton of claim 14, wherein a first upper portion of each of the first side end flap and the second side end flap is foldably connected to a second upper portion of the respective first reinforcing flap and second reinforcing flap, and the first upper portion of each of the first side end flap and the second side end flap is at least partially in face-to-face contact with the second upper portion of the respective first reinforcing flap and second reinforcing flap above the handle opening.

17. The carton of claim 14, wherein the second fold line and the third fold line are interrupted by the handle opening so that the second fold line and the third fold line extend generally upwardly and downwardly from the handle opening.

18. The carton of claim 14, wherein the first side end flap and the second side end flap at least partially overlap the respective first reinforcing flap and second reinforcing flap in the closed end of the carton.

19. The carton of claim 13, wherein the second reinforcing flap has a free edge that is parallel to the third fold line.

20. The carton of claim 19, wherein the free edge of the second reinforcing flap is offset from the third fold line.

21. The carton of claim 1, wherein the free edge of the side flap extends below the lower edge of the reinforcing flap and is parallel to the second fold line.

22. A blank for forming a carton for holding a plurality of articles, the blank comprising:

a plurality of panels comprising at least a top panel and a side panel;

a plurality of end flaps respectively foldably connected to respective panels of the plurality of panels, wherein the plurality of end flaps are for being at least partially overlapped with respect to one another to thereby at least partially form a closed end of the carton formed from the blank, the plurality of end flaps comprising at least a side end flap foldably connected to the side panel along a first fold line;

handle features for forming a handle in the closed end of the carton formed from the blank, the handle features extending in at least the side end flap; and a reinforcing flap foldably connected to the side end flap along a second fold line, wherein the reinforcing flap is for at least partially overlapping the side end flap for reinforcing the handle when the carton is formed from the blank, a portion of the side end flap having a free edge that is collinear with the second fold line, the handle comprises a first opening in the side end flap and a second opening in the reinforcing flap, and the first opening and the second opening are for being generally aligned with one another in the closed end when the carton is formed from the blank, and the side end flap comprises an upper edge and a lower edge opposite the upper edge and the second fold line extends from the upper edge and the lower edge, and the second fold line is interrupted by the first opening and the second opening so that the second fold line extends generally upwardly and downwardly from the first opening and the second opening when the carton is formed from the blank.

23. The blank of claim 22, wherein the second fold line extends from an edge of the first opening and the second opening.

24. The blank of claim 22, wherein a first upper portion of the side end flap is foldably connected to a second upper portion of the reinforcing flap, and the first upper portion is for being disposed at least partially in face-to-face contact with the second upper portion above the first opening and the second opening when the carton is formed from the blank.

25. The blank of claim 24, wherein the reinforcing flap is foldably connected to the side end flap on an opposite side of the first opening and the second opening from the first upper portion and the second upper portion.

26. The blank of claim 22, wherein the side end flap comprises an upper flap connected to a lower flap by at least a connector panel, and the reinforcing flap is foldably connected to the upper flap along the second fold line.

27. The blank of claim 26, further comprising a corner flap foldably connected to the lower flap of the side end flap, and the corner flap is for being folded with respect to the side end flap to extend adjacent a corner of the carton formed from the blank.

28. The blank of claim 22, further comprising an article protection feature in the closed end of the carton, the article protection feature comprising at least a deformation extending in at least the reinforcing flap.

29. The blank of claim 28, wherein the deformation further extends in the side end flap and the second fold line extends at least partially across the deformation.

30. The blank of claim 28, wherein the article protection feature further comprises an aperture in the side end flap adjacent the deformation in the reinforcing flap, the aperture interrupting the second fold line.

31. The blank of claim 30, wherein:

the side panel is a first side panel, the side end flap is a first side end flap, the reinforcing flap is a first reinforcing flap, and the deformation is a first deformation;

the plurality of panels comprises a second side panel, the plurality of end flaps comprises a second side end flap foldably connected to the second side panel, and a second reinforcing flap is foldably connected to the second side flap; and the article protection feature comprises a second deformation extending in the second reinforcing flap and the second side end flap, wherein the first side end flap and the first reinforcing flap are for at least partially overlapping the second side end flap and the second reinforcing flap so that the first deformation, the second deformation, and the aperture are generally aligned in the closed end of the carton formed from the blank.

32. The blank of claim 22, wherein:

the side panel is a first side panel, the side end flap is a first side end flap, and the reinforcing flap is a first reinforcing flap;

the plurality of panels comprises a second side panel, the plurality of end flaps comprises a second side end flap foldably connected to the second side panel, a second reinforcing flap is foldably connected to the second side flap along a third fold line, the handle features further extend in the second side end flap, and the second reinforcing flap is for at least partially overlapping the second side end flap for reinforcing the handle when the carton is formed from the blank.

33. The blank of claim 32, wherein the second reinforcing flap has a free edge that is parallel to the third fold line.

34. The blank of claim 33, wherein the free edge of the second reinforcing flap is offset from the third fold line.

35. The blank of claim 22, wherein the free edge of the side flap extends below the lower edge of the reinforcing flap and is parallel to the second fold line.

36. A method of forming a carton for holding a plurality of articles, the method comprising:

obtaining a blank comprising a plurality of panels comprising at least a top panel and a side panel, a plurality of end flaps respectively foldably connected to respective panels of the plurality of panels, the plurality of end flaps comprising at least a side end flap foldably connected to the side panel along a first fold line, handle features extending in at least the side end flap, and a reinforcing flap foldably connected to the side end flap along a second fold line, a portion of the side end flap having a free edge that is collinear with the second fold line, the handle comprises a first opening in the side end flap and a second opening in the reinforcing flap, the side end flap comprises an upper edge and a lower edge opposite the upper edge and the second fold line extends from the upper edge and the lower edge, and the second fold line is interrupted by the first opening and the second opening;

positioning the reinforcing flap to at least partially overlap the side end flap;

at least partially forming an interior of the carton by positioning the plurality of panels to form a generally open-ended sleeve; and at least partially overlapping the end flaps of the plurality of end flaps with respect to one another to at least partially form a closed end of the carton, the at least partially overlapping the end flaps at least partially forming a handle from the handle features in the closed end of the carton, the reinforcing flap at least partially reinforcing the handle and the first opening and the second opening being generally aligned in the closed end.

37. The method of claim 36, wherein a first upper portion of the side end flap is foldably connected to a second upper portion of the reinforcing flap, and the positioning the reinforcing flap comprises positioning the second upper portion to be at least partially in face-to-face contact with the first upper portion above the first opening and the second opening.

38. The method of claim 36, wherein:

the side panel is a first side panel, the side end flap is a first side end flap, and the reinforcing flap is a first reinforcing flap; and the plurality of panels comprises a second side panel, the plurality of end flaps comprises a second side end flap foldably connected to the second side panel, and a second reinforcing flap is foldably connected to the second side flap along a third fold line, the handle further extending in the second side end flap and the second reinforcing flap;

the method further comprising positioning the second reinforcing flap to at least partially overlap the second side end flap for reinforcing the handle, and the at least partially overlapping the end flaps of the plurality of end flaps further comprises folding the first side end flap and the second side end flap to at least partially form the closed end of the carton.

39. The method of claim 38, wherein the at least partially forming the handle from the handle features comprises forming a handle opening extending in the first side end flap, the second side end flap, the first reinforcing flap, and the second reinforcing flap.

40. The method of claim 39, wherein the plurality of end flaps further comprises a top end flap foldably connected to the top panel, the handle features further comprise a handle flap foldably connected to the top end flap, the at least partially overlapping the end flaps of the plurality of end flaps further comprises folding the top end flap to at least partially overlap the first side end flap and the second side end flap so that the handle flap is generally aligned with the handle opening.

41. The method of claim 38, wherein the second reinforcing flap has a free edge that is parallel to the third fold line.

42. The blank of claim 41, wherein the free edge of the second reinforcing flap is offset from the third fold line.

43. The method of claim 36, wherein the free edge of the side flap extends below the lower edge of the reinforcing flap and is parallel to the second fold line.

* * * * *